US005505134A

United States Patent [19]

Brooks et al.

[11] Patent Number: 5,505,134

[45] Date of Patent: Apr. 9, 1996

[54] PERFORATING GUN HAVING A PLURALITY OF CHARGES INCLUDING A CORRESPONDING PLURALITY OF EXPLODING FOIL OR EXPLODING BRIDGEWIRE INITIATOR APPARATUS RESPONSIVE TO A PULSE OF CURRENT FOR SIMULTANEOUSLY DETONATING THE PLURALITY OF CHARGES

[75] Inventors: James E. Brooks, Manvel; Nolan C. Lerche, Stafford; Clifford L. Aseltine, Houston; Kenneth E. Rozek, Houston; Robert A. Parrott, Houston, all of Tex.

[73] Assignee: Schlumberger Technical Corporation, Houston, Tex.

[21] Appl. No.: 220,071

[22] Filed: Mar. 29, 1994

Related U.S. Application Data

[63] Continuation-in-part of Ser. No. 116,082, Sep. 1, 1993, Pat. No. 5,347,929.

[51] Int. Cl.[6] ..... F42C 19/12

[52] U.S. Cl. ..... 102/203.7

[58] Field of Search ..... 102/202.14, 200, 102/202.5, 307, 306, 202.7, 202.11, 206; 175/4.6; 361/248

[56] References Cited

U.S. PATENT DOCUMENTS 3,181,463 5/1965 Morgan et al. .

(List continued on next page.)

FOREIGN PATENT DOCUMENTS 0601880 6/1954 European Pat. Off. .
2100395 8/1984 United Kingdom .
2226872 7/1990 United Kingdom .
2265209 9/1993 United Kingdom .

OTHER PUBLICATIONS

"Small Helical Flux Compression Amplifier" by J. E. Gover, O. M. Stuetzer, and J. L. Johnson, Sandia Laboratories, Megagauss Physics and Technology, 1979.

(List continued on next page.)

*Primary Examiner*—Daniel T. Pihulic
*Attorney, Agent, or Firm*—John H. Bouchard

[57] ABSTRACT

A perforating apparatus adapted to be disposed in a wellbore includes a plurality of shaped charges, an electrical current carrying conductor, and a plurality of exploding foil or exploding bridgewire initiators disposed, respectively, between the plurality of charges and the current carrying conductor for simultaneously detonating thereby simultaneously detonating all of the plurality of shaped charges of the perforating apparatus in response to a current flowing in the conductor. Each of the shaped charges include a new secondary explosive primer disposed in the apex of the charge for detonating in response to a detonation of the exploding foil or exploding bridgewire initiator. The electrical conductor may include a flat cable having a plurality of such initiators spaced apart at predetermined intervals along the cable and adapted to wrap helically around the perforating apparatus until each of the initiators abut against a shaped charge of the plurality of charges in the perforating apparatus. In an alternate embodiment, the electrical current carrying conductor may include a flat sheet having a specific length and width and including a plurality of such initiators. The flat sheet is adapted to wrap around the entire circumference of the perforating apparatus until each of the initiators in the sheet abut against a shaped charge of the plurality of charges in the perforating apparatus. The current in the conductor may originate from a compressed magnetic flux (CMF) current pulse generator or from a charging capacitor of a conventional system including one or more charging capacitors and associated discharge switches. When the perforating apparatus includes a first and second perforator separated by an adaptor, the adaptor includes a pressure bulkhead adapted to seal the first perforator from the second perforator, an explosive disposed in contact against one side of the bulkhead and a piezoelectric ceramic disposed in contact against the other side of the bulkhead.

62 Claims, 11 Drawing Sheets

U.S. PATENT DOCUMENTS

| | | | |
|---|---|---|---|
| 3,640,224 | 2/1972 | Petrick et al. . | |
| 3,695,368 | 10/1972 | Lanmon, II | 175/4.6 |
| 3,978,791 | 9/1976 | Lemley et al. . | |
| 4,422,381 | 12/1983 | Barrett . | |
| 4,441,427 | 4/1984 | Barrett . | |
| 4,471,697 | 9/1984 | McCormick et al. . | |
| 4,517,497 | 5/1985 | Malone | 361/251 |
| 4,559,875 | 12/1985 | Marshall . | |
| 4,627,353 | 12/1986 | Chawla | 102/307 |
| 4,658,900 | 4/1987 | Stout . | |
| 4,669,384 | 6/1987 | Chawla et al. | 102/307 |
| 4,735,145 | 4/1988 | Johnson et al. . | |
| 4,762,067 | 8/1988 | Barker et al. . | |
| 4,777,878 | 10/1988 | Johnson et al. . | |
| 4,944,225 | 7/1990 | Barker . | |
| 4,955,939 | 9/1990 | Petrousky et al. | 102/307 |
| 5,074,167 | 12/1991 | Yoshimura et al. . | |
| 5,088,413 | 2/1992 | Huber et al. . | |
| 5,094,167 | 3/1992 | Hendley, Jr. . | |
| 5,347,929 | 9/1994 | Lerche et al. | 102/202.14 |

OTHER PUBLICATIONS

"The Central Power Supply", Showcase for Technology, Conference and Exposition, 1981.

"A New Kind of Detonator–the Slapper" by J. R. Stroud, Lawrence Livermore Laboratory, University of California, Livermore, California, pp. 22–1 through 22–6.

"Shock Initiation of Explosive Pellets at Low Temperatures" D. S. Gilman, Lawrence Livermore Laboratory, pp. 41–1 through 41–5.

"A Low–Energy Flying Plate Detonator" by Albin K. Jacobson, Sandia National Laboratories, Albuquerque, New Mexico, pp. 49–1 through 49–20.

"High Temperature Stable Detonators" by Robert H. Dinegar, Proc 12th Symposium on Explosives and Pyrotechnics, San Diego, Calif. Mar. 13–15, 1984, Los Alamos National Laboratory, pp. 4–1 through 4–4.

"National Course on Fuzing and Initiation Session VI Initiation Systems" by Dick Weingart, Lawrence Livermore National Laboratory Sep. 1989.

"A Fast, Low Resistance Switch for Small Slapper Detonators" by D. D. Richardson and D. A. Jones, Department of Defense Materials Research Laboratories, Report MRL–R–1030, Oct. 1986.

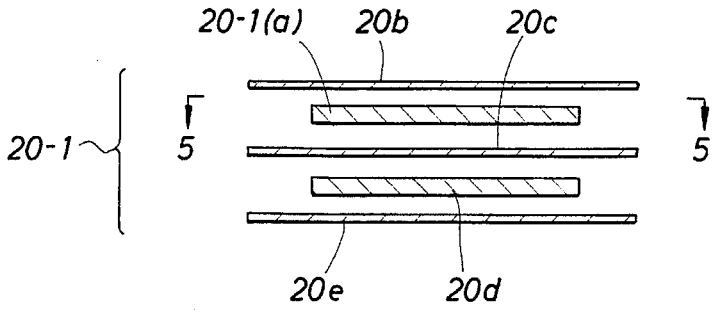
FIG. 4
FIG. 5
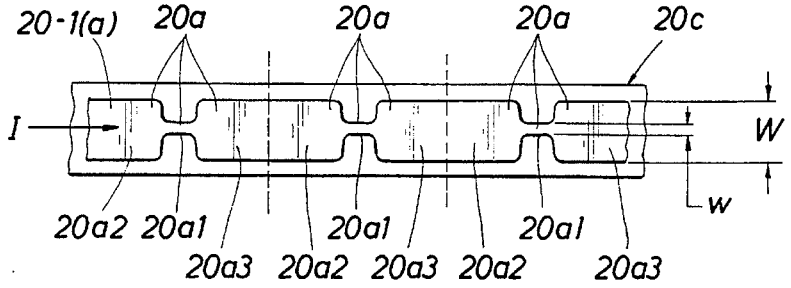
FIG. 6
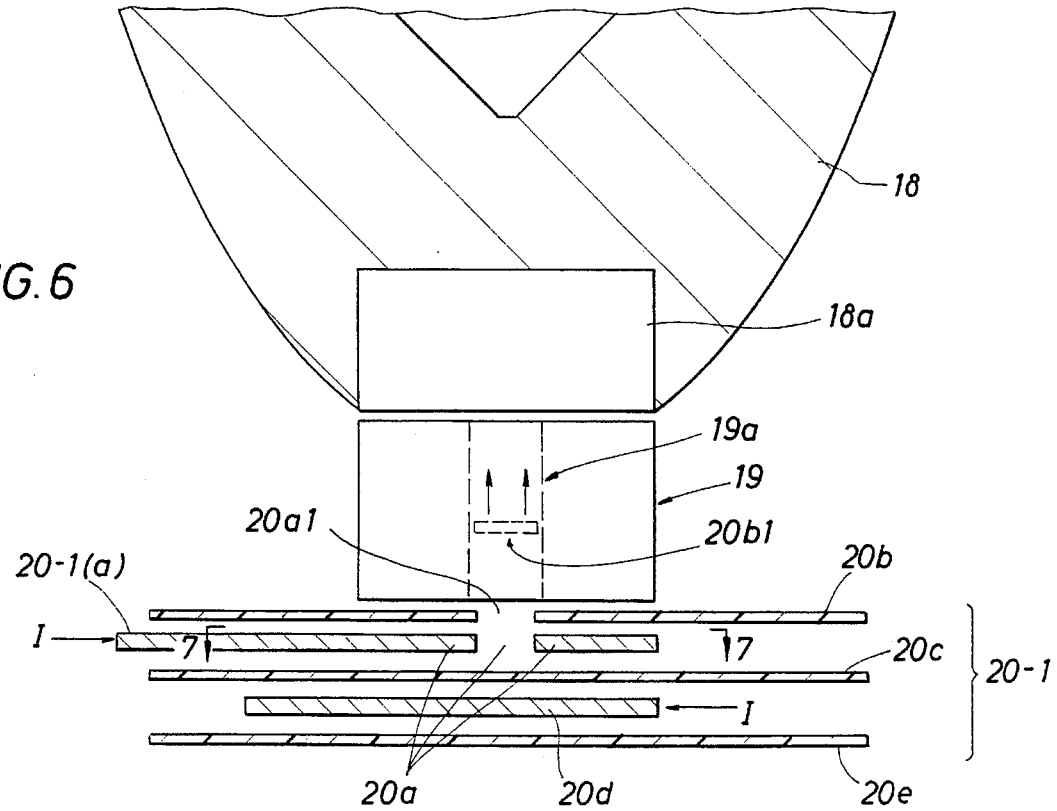

FIG. 7
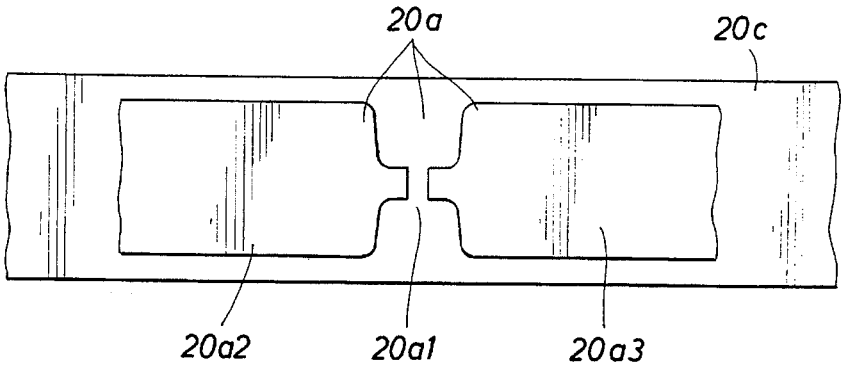
FIG. 8
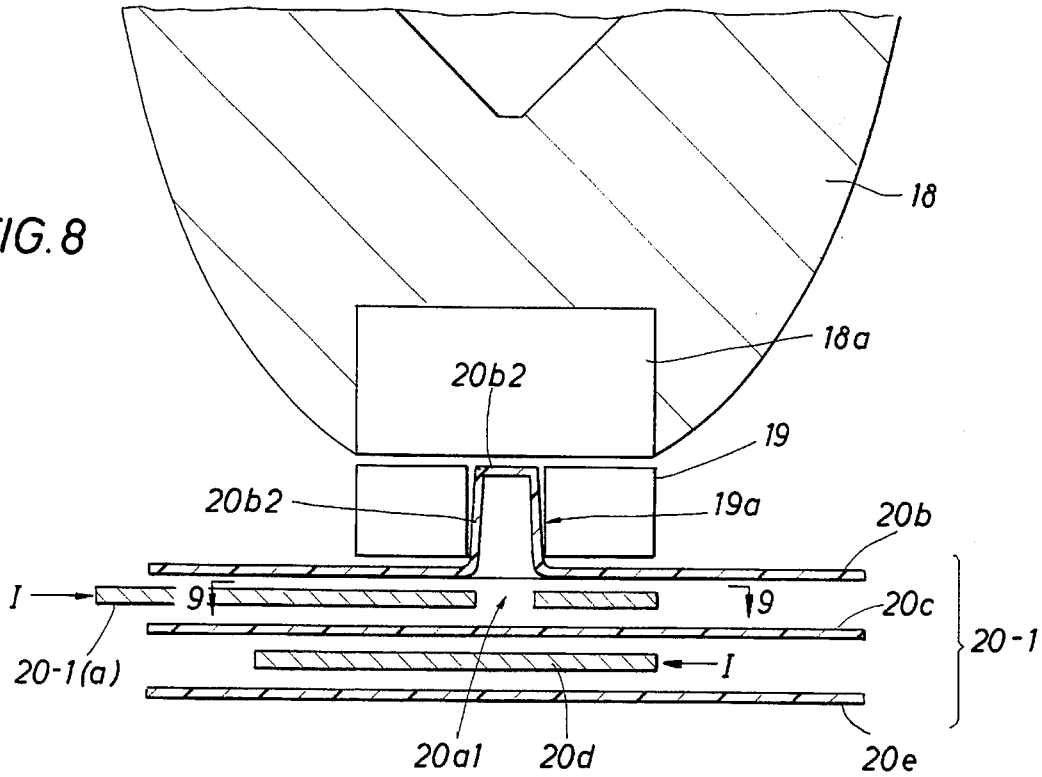
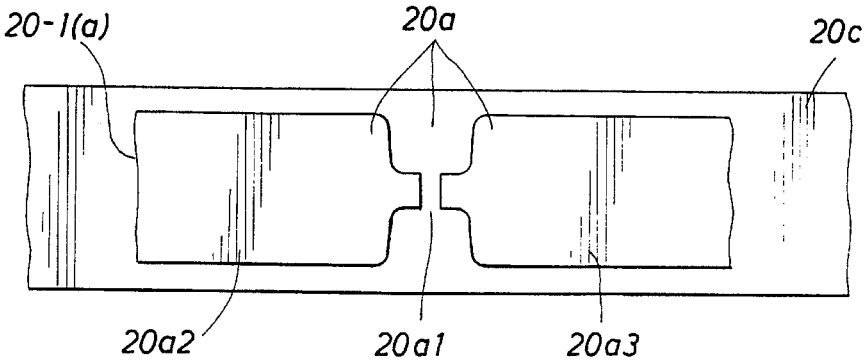
FIG. 9

PERFORATING GUN HAVING A PLURALITY OF CHARGES INCLUDING A CORRESPONDING PLURALITY OF EXPLODING FOIL OR EXPLODING BRIDGEWIRE INITIATOR APPARATUS RESPONSIVE TO A PULSE OF CURRENT FOR SIMULTANEOUSLY DETONATING THE PLURALITY OF CHARGES

CROSS REFERENCE TO RELATED APPLICATIONS

This application is a continuation in part of application Ser. No. 08/116,082, filed Sep. 1, 1993, now U.S. Pat. No. 5,347,929, entitled "Firing System for a Perforating Gun Including an Exploding Foil Initiator and an Outer Housing for Conducting Wireline Current and EFI Current"

BACKGROUND OF THE INVENTION

The subject matter of the present invention relates to a method and apparatus for simultaneously initiating the detonation of a plurality of shaped charges in a perforating gun adapted to be disposed in a wellbore. The perforating gun includes an electrical current carrying conductor, a current pulse generator connected to the conductor, a plurality of shaped charges, and a plurality of exploding foil or exploding bridgewire initiators connected, respectively, between the plurality of charges and the current carrying conductor for simultaneously detonating the charges in response to a pulse of current from the current pulse generator. Exploding bridge wire initiators and exploding foil initiators are known in the art. For example, U.S. Pat. No. 3,181,463 to Morgan et al discloses an exploding bridge wire detonator. In addition, U.S. Pat. No. 5,088,413 to Huber et al, assigned to the same assignee as that of the present invention, entitled "Method and Apparatus for Safe Transport Handling Arming and Firing of Perforating Guns using a Bubble Activated Detonator" discloses an exploding foil "bubble activated" initiator which utilizes a bubble instead of a flying plate to detonate an explosive charge, In addition, prior application Ser. No. 08/116,082, filed Sep. 1, 1993, now U.S. Pat. No. 5,347,929, entitled "Firing System for a Perforating Gun including an Exploding Foil Initiator and an Outer Housing for conducting Wireline current and EFI current", assigned to the same assignee as that of the present invention, discloses a firing head, utilizing an exploding foil flying plate or the bubble activated initiator of the Huber et al patent, for use in a perforating gun. In addition, exploding foil "flying plate" initiators are known in the art. For example, U.S. Pat. No. 4,788,913 to Stroud et al, entitled "Flying Plate Detonator using a High Density High Explosive" discloses an exploding foil flying plate initiator. The flying plate initiator has been disclosed in connection with a perforating gun in U.S. Pat. No. 4,762,067 to Barker et al, entitled "Downhole Perforating Method and Apparatus using Secondary Explosive Detonators". However, the exploding foil "flying plate" initiator in the Barker et al patent patent initiates a detonation wave in a detonating cord, and the detonation wave in the detonating cord subsequently detonates a plurality of charges in the perforating gun.

Instead of using a conventional detonation wave to detonate a plurality of shaped charges in a perforating gun, it would be desirable to use an electrical current pulse generator to flow a pulse of current in an electrical current carrying conductor and to use that pulse of current to detonate a plurality of shaped charges in a perforating gun.

U.S. Pat. No. 5,094,167 to Hendley, Jr uses an ordinary current conducting in an electrical conductor to detonate a plurality of shaped charges in a perforating gun. Each of the shaped charges in the Hendley patent include an initiator known as a semiconductor bridge initiator. Although the semiconductor bridge initiator is useful for some purposes, it would be more desirable to use a plurality of exploding foil or exploding bridgewire initiators, in lieu of the semiconductor bridge initiator, to detonate a respective plurality of shaped charges-in a perforating gun. None of the shaped charges in the Hendley patent utilize an exploding bridgewire initiator or an exploding foil flying plate or bubble activated initiator (EFI initiator).

U.S. Pat. No. 4,658,900 to Stout entitled "High Energy Firing Head for Well Perforating Guns" discloses a single shaped charge which includes a flying plate initiator. This single shaped charge is pointing downwardly in a perforating gun, and the jet from the shaped charge initiates a detonation wave in a detonating cord. However, since the detonating cord is connected to the plurality of shaped charges, the shaped charges are detonated by the detonation wave in the detonating cord, not by an electrical current flowing in an electrical current conductor.

In addition, recall that, in addition to a plurality of shaped charges and a corresponding plurality of initiators, a current pulse generator is also connected to the electrical current carrying conductor. The current pulse generator could comprise a prior art charging circuit including a large capacitor charged by a charging current from a high voltage source, or a prior art compressed magnetic flux (CMF) generator. The prior art CMF generator is described in an article entitled "Small Helical Flux Compression Amplifiers" by J. E. Gover, O. M. Stuetzer, and J. L. Johnson, Sandia Laboratories, Albuquerque, N. Mex., printed in "Megagauss Physics and Technology", 1979. The CMF generator is also described in an article entitled "The Central Power Supply", Showcase for Technology, conference and exposition, 1981.

Therefore, it would be desirable to provide a new perforating system adapted to be disposed in a wellbore which propagates a current pulse from a current pulse generator through an electrical current carrying conductor to a plurality of initiators corresponding, respectively, to a plurality of shaped charges of the perforating system, and to use that current pulse to simultaneously detonate the plurality of initiators and the plurality of shaped charges of the perforating system.

In addition, it would be further desirable to provide a new preferred design for a shaped charge adapted for use in connection with the new perforating system.

It would be further desirable to provide a new preferred design for an electrical current carrying conductor adapted for use in connection with the new shaped charge in the new perforating system.

It would be further desirable to provide a new preferred design for a current pulse generator adapted for use in connection with the new current carrying conductor in the new perforating system.

SUMMARY OF THE INVENTION

It is a primary object of the present invention to provide a system including an explosive device, an electrical current carrying conductor, and an exploding foil or exploding bridgewire initiator disposed between the current carrying conductor and the explosive device and electrically connected to the current carrying conductor for detonating the explosive device in response to an electrical current conducting in the current carrying conductor.

It is a further object of the present invention to provide a system including a shaped charge, an electrical current carrying conductor, and an exploding foil or exploding bridgewire initiator disposed between the current carrying conductor and the shaped charge and electrically connected to the current carrying conductor for detonating the shaped charge in response to an electrical current conducting in the conductor.

It is a further object of the present invention to provide a system including a shaped charge, an electrical current carrying conductor, and an exploding foil flying plate initiator disposed between the current carrying conductor and the shaped charge and electrically connected to the current carrying conductor for detonating the shaped charge in response to an electrical current conducting in the conductor.

It is a further object of the present invention to provide a system including a shaped charge, an electrical current carrying conductor, and an exploding foil bubble activated initiator disposed between the current carrying conductor and the shaped charge and electrically connected to the current carrying conductor for detonating the shaped charge in response to an electrical current conducting in the conductor.

It is a further object of the present invention to provide a system including an electrical current carrying conductor, a shaped charge connected to one end of the current carrying conductor, a compressed magnetic flux current pulse generator connected to the other end of the current carrying conductor for generating a current pulse and conducting the current pulse in the conductor, and an exploding foil or exploding bridgewire initiator disposed between the current carrying conductor and the shaped charge and electrically connected to the conductor for detonating the shaped charge in response to the current pulse conducting in the current carrying conductor.

It is a further object of the present invention to provide a system including an electrical current carrying conductor, a shaped charge connected to one end of the current carrying conductor, a current pulse generator, which includes a charging capacitor connected to a discharge switch and a high voltage supply, connected to the other end of the current carrying conductor for generating a current pulse and conducting the current pulse in the conductor, and an exploding foil or exploding bridgewire initiator disposed between the current carrying conductor and the shaped charge and electrically connected to the conductor for detonating the shaped charge in response to the current pulse conducting in the current carrying conductor.

It is a further object of the present invention to provide a system including a plurality of electrical current carrying conductors, a plurality of shaped charges connected to one end of the current carrying conductors, a current pulse generator connected to the other end of the current carrying conductors for generating a current pulse and conducting the current pulse in the conductors, and a plurality of exploding foil or exploding bridgewire initiators disposed, respectively, between the plurality of shaped charges and the current carrying conductors and electrically connected to the conductors for simultaneously detonating the plurality of shaped charges in response to the current pulse conducting in the current carrying conductor, where the current pulse generator includes a plurality of charging capacitors connected, respectively, to the plurality of current carrying conductors and to a high voltage source.

It is a primary object of the present invention to provide a perforating gun including a plurality of shaped charges, an electrical current carrying conductor, and a plurality of exploding foil or exploding bridgewire initiators disposed, respectively, between the plurality of shaped charges and the current carrying conductor and electrically connected to the current carrying conductor for simultaneously detonating the plurality of shaped charges in response to an electrical current conducting in the conductor.

It is a primary object of the present invention to provide a perforating gun including a plurality of shaped charges, an electrical current carrying conductor, and a plurality of exploding foil flying plate initiators disposed, respectively, between the plurality of shaped charges and the current carrying conductor and electrically connected to the current carrying conductor for simultaneously detonating the plurality of shaped charges in response to an electrical current conducting in the conductor.

It is a primary object of the present invention to provide a perforating gun including a plurality of shaped charges, an electrical current carrying conductor, and a plurality of exploding foil bubble activated initiators disposed, respectively, between the plurality of shaped charges and the current carrying conductor and electrically connected to the current carrying conductor for simultaneously detonating the plurality of shaped charges in response to an electrical current conducting in the conductor.

It is a primary object of the present invention to provide a perforating gun including a plurality of shaped charges, an electrical current carrying flat conductor cable helically wrapped around and in contact with the plurality of shaped charges, and a plurality of exploding foil or exploding bridgewire initiators disposed, respectively, between the plurality of shaped charges and the current carrying flat conductor cable and electrically connected to the current carrying flat conductor cable for simultaneously detonating the plurality of shaped charges in response to an electrical current conducting in the conductor.

It is a primary object of the present invention to provide a perforating gun including a plurality of shaped charges, an electrical current carrying flat sheet of conductor material wrapped around the entire circumference of the perforating gun and in contact with the plurality of shaped charges, and a plurality of exploding foil or exploding bridge fire initiators disposed, respectively, between the plurality of shaped charges and the current carrying flat sheet of conductor material and electrically connected to the current carrying flat sheet of conductor material for simultaneously detonating the plurality of shaped charges in response to an electrical current conducting in the conductor.

It is a further object of the present invention to provide a system including a perforating gun having a plurality of shaped charges, an electrical current carrying conductor having one end connected to the plurality of shaped charges, a compressed magnetic flux current pulse generator connected to the other end of the current carrying conductor, and a plurality of exploding foil or exploding bridgewire initiators disposed between the plurality of shaped charges and the current carrying conductor for simultaneously detonating the plurality of shaped charges in response to an electrical current conducting in the current carrying conductor.

It is a further object of the present invention to provide a system including a perforating gun having a plurality of shaped charges, an electrical current carrying conductor having one end connected to the plurality of shaped charges, a current pulse generator, including a charging capacitor connected to a high voltage supply and a discharge switch, connected to the other end of the current carrying conductor, and a plurality of exploding foil or exploding bridgewire initiators disposed between the plurality of shaped charges and the current carrying conductor for simultaneously detonating the plurality of shaped charges in response to an electrical current conducting in the current carrying conductor.

It is a further object of the present invention to provide a system including a perforating gun having a plurality of shaped charges, a plurality of electrical current carrying conductors connected to the plurality of shaped charges, a current pulse generator connected to the current carrying conductors, and a plurality of exploding foil or exploding bridgewire initiators disposed, respectively, between the plurality of shaped charges and the current carrying conductors for simultaneously detonating the plurality of shaped charges in response to an electrical current conducting in the current carrying conductors, where the current pulse generator includes a plurality of charging capacitors connected, respectively, to the plurality of current carrying conductors and to a high voltage source.

It is a further object of the present invention to provide a detonation transfer unit adapted to be disposed between a first perforating gun and a second perforating gun of a perforating apparatus for transferring a detonation wave from a detonating cord of the first perforating gun to a detonating cord of the second perforating gun, the detonation transfer unit including a pressure bulkhead adapted to isolate and insulate the pressure disposed within an interior of the first perforating gun from the pressure disposed within an interior of the second perforating gun, an explosive plane wave generator associated with the first perforating gun being disposed in abutment against one side of the pressure bulkhead, and a piezoelectric ceramic being disposed in abutment against the other side of the pressure bulkhead and connected to a detonator associated with the second perforating gun.

It is a further object of the present invention to provide a new shaped charge adapted for use in connection with a new perforating system in accordance with the present invention including a new secondary explosive pellet disposed within an apex of the shaped charge, the explosive material of the new secondary explosive pellet being specifically selected for use in connection with exploding foil initiators or exploding bridgewire initiators.

It is a further object of the present invention to provide a new shaped charge adapted for use in connection with a new perforating system in accordance with the present invention including a new secondary explosive pellet having a first density and disposed within an apex of the shaped charge and a main body of explosive having a second density, the first density of the pellet being less than the second density of the main body of explosive.

In accordance with these and other objects of the present invention, a new system, such as a perforating apparatus, adapted to be disposed in a wellbore, includes a first current pulse generator for generating a pulse of current; a first electrical current carrying conductor connected to the current pulse generator for receiving the pulse of current from said current pulse generator and conducting said current; a first plurality of explosive devices, such as a first plurality of shaped charges in the perforating apparatus, which are adapted to detonate; and a first plurality of initiators disposed, respectively, between the first plurality of explosive devices and the first electrical current carrying conductor and electrically connected to the first current carrying conductor for receiving the current from the first current carrying conductor and substantially simultaneously detonating in response to the current, the first plurality of explosive devices substantially simultaneously detonating in response to the substantially simultaneous detonation of the first plurality of initiators. A second electrical current carrying conductor is connected to the first electrical current carrying conductor via an intermediate adaptor. A second current pulse generator is electrically connected between the intermediate adaptor and the second current carrying conductor, and a second plurality of initiators are mounted on the second current carrying conductor. In the same manner as described above in connection with the first plurality of explosive devices, a second plurality of explosives devices, such as a second plurality of shaped charges, are substantially simultaneously detonated in response to the substantially simultaneous detonation of the second plurality of initiators. Therefore, the detonation of the first plurality of explosive devices by current flowing in the first electrical current carrying conductor is repeated again in connection with the second plurality of explosive devices and the second electrical current carrying conductor. Each of the initiators include either an exploding foil flying plate initiator or an exploding foil bubble activated initiator or an exploding bridgewire initiator (hereinafter collectively referred to as an "EFI initiator"). Each of the initiators mounted on the current carrying conductor substantially simultaneously detonate in response to the pulse of current flowing in the conductor. When the plurality of initiators substantially simultaneously detonate, the plurality of explosive devices, such as the plurality of shaped charges, also substantially simultaneously detonate.

In accordance with a preferred embodiment of the present invention, the plurality of exploding foil (either flying plate or bubble activated) initiators are mounted on an electrical current carrying flat cable conductor, and the flat conductor cable is helically wrapped around the exterior of a new perforating apparatus in accordance with the present invention in a manner which allows the plurality of exploding foil initiators on the flat conductor cable to abut, respectively, against the apex of a plurality of new shaped charges. In response to the current pulse conducting in the flat cable conductor, the exploding foil initiators will simultaneously detonate. When the exploding foil initiators detonate, the plurality of shaped charges also substantially simultaneously detonate. The flat cable conductor includes a first plurality of parallel connected exploding foil or exploding bridgewire initiators, a second plurality of parallel connected exploding foil or exploding bridgewire initiators, a third plurality of parallel connected exploding foil or exploding bridgewire initiators, etc. The first plurality of parallel connected exploding foil or exploding bridgewire initiators detonate simultaneously in response to the current conducting in the flat cable conductor which is helically wrapped around the exterior of the perforating gun. The second plurality of parallel connected exploding foil or exploding bridgewire initiators detonate simultaneously with the detonation of the first plurality of parallel connected initiators in response to the current conducting in the flat cable conductor. The third plurality of parallel connected exploding foil or exploding bridgewire initiators detonate simultaneously with the detonation of the first plurality of parallel connected initiators and the second plurality of parallel connected initiators in response to the current conducting in the flat cable conductor, etc. As a result, all of the parallel connected initiators on the flat cable conductor detonate approximately simultaneously, that is, over a short period of time of approximately 100 nano-seconds.

In accordance with another embodiment of the present invention, instead of using a flat cable conductor which wraps helically around the perforating apparatus, a sheet containing a plurality of exploding foil or exploding bridgewire initiators is utilized. The sheet has a width and the width of the sheet is approximately equal to a circumference of the perforating apparatus. The sheet of initiators is wrapped completely around the entire circumference of the perforating apparatus in a manner which allows the plurality of initiators on the sheet to abut, respectively, against an apex of the plurality of shaped charges. Since each exploding foil or exploding bridgewire initiator abuts against it's respective shaped charge, when the plurality of exploding foil or exploding bridgewire initiators on the sheet substantially simultaneously detonate, the plurality of shaped charges of the perforating apparatus will also substantially simultaneously detonate.

In accordance with another aspect of the present invention, since the plurality of shaped charges of the new perforating apparatus of the present invention detonate in response to a current conducting in an electrical current carrying conductor and since a plurality of exploding foil or exploding bridgewire initiaters are mounted on the conductor adjacent the shaped charges, each of the shaped charges must now be redesigned to detonate in response to a detonation of an exploding bridgewire or an impact by a flying plate or an expanding bubble of an exploding foil flying plate or bubble activated initiator. Recall that each shaped charge includes a main body of explosive and a secondary explosive pellet disposed within the apex of the charge adjacent the main body of explosive. Therefore, the secondary explosive pellet must now detonate in response to a detonation of an exploding bridgewire or in response to an impact from a flying plate or an expanding bubble of an exploding foil flying plate or bubble activated initiator. As a result, the secondary explosive pellet must now be selected from the following group consisting of: HNS-IV, NONA, HMX, RDX, PETN, TATB, ABH, BTX, DPO, DODECA, Tripicryl-trinitrobenzene, barium styphnate, and metallic picrate salts.

In accordance with still another aspect of the present invention, during manufacture, the secondary explosive pellet of a new shaped charge, for use in connection with the new perforating apparatus of the present invention, is pressed to a first density, and the main body of explosive is pressed to a second density, where the first density of the secondary explosive pellet is less than the second density of the main body of explosive.

In accordance with another further embodiment of the present invention, a current pulse generator is electrically connected to an electrically conductive layer of the flat cable conductor which is helically wrapped around an interior or an exterior of the perforating apparatus, or the current pulse generator is electrically connected to an electrically conductive layer disposed within the flat sheet of exploding foil or exploding bridgewire initiators which is wrapped around the circumference of the perforating apparatus. The current pulse generator develops a current pulse of sufficient amplitude and pulse width to substantially simultaneously detonate each of the plurality of exploding foil or exploding bridgewire initiators on the flat cable conductor or the flat sheet. The current pulse generator can include the conventional charging capacitor connected to a high voltage source and a discharge switch. The current pulse generator can also comprise a plurality of parallel connected charging capacitors connected to a high voltage source, a plurality of discharge switches connected to the plurality of capacitors, and a corresponding plurality of conductors connected, respectively, to the plurality of discharge switches and the plurality of shaped charges. However, in accordance with a preferred embodiment of the present invention, the current pulse generator is a compressed magnetic flux (CMF) generator which generates a current pulse from a last turn of an inductance coil in response to a detonation wave induced in an explosive armature of the CMF generator. The detonation wave in the armature of the CMF generator is induced therein by a separate firing system disposed in the perforating apparatus. Although any suitable firing system may be utilized, one example of that separate firing system is disclosed in prior pending application Ser. No. 08/116,082, filed Sep. 1, 1993, now U.S. Pat. No. 5,347, 929, entitled "Firing System for a Perforating gun Including an Exploding Foil Initiator and an Outer Housing for Conducting Wireline Current and EFI Current", the disclosure of which is incorporated by reference into the specification of this application.

In accordance with another aspect of the present invention, a detonation transfer unit is adapted to be disposed between a first perforating gun and a second perforating gun of a perforating apparatus. The detonation transfer unit transfers a detonation wave from a first detonating cord of the first perforating gun to a second detonating cord of the second perforating gun of the perforating apparatus. The detonation transfer unit includes a pressure bulkhead which is adapted to isolate and insulate the pressure disposed within the interior of the first perforating gun from the pressure plane wave generator disposed within the interior of the second perforating gun. An explosive plane wave generator associated with the first detonating cord of the first perforating gun is disposed in contact with one side of the pressure bulkhead and a piezoelectric ceramic disc is disposed in contact with the other side of the pressure bulkhead. The piezoelectric ceramic stores energy and is connected to a detonator. The detonator is connected to the detonating cord of the second perforating gun. When a first detonation wave from the first detonating cord of the first perforating gun hits the explosive plane wave generator, the resultant explosive plane wave of the first detonation wave is transferred through the bulkhead to the piezoelectric ceramic disposed on the other side of the bulkhead thereby causing the energy stored in the piezoelectric ceramic to dump into the detonator of the second detonating cord. As a result, in response to the energy from the piezoelectric ceramic, the detonator initiates the propagation of a second detonation wave in the second detonating cord of the second perforating gun of the perforating apparatus.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 4 illustrates a cross section of the electrical current carrying conductor of FIG. 3.

FIG. 5 illustrates a section of FIG. 4 taken along section lines 5—5 of FIG. 4.

FIG. 6 illustrates an expanded view of one of the shaped charges of FIGS. 2 or 3 including the current carrying conductor and an associated exploding foil "flying plate" initiator.

FIG. 7 illustrates a section of the current carrying conductor of FIG. 6 taken along section lines 7—7 of FIG. 6.

FIG. 8 illustrates an expanded view of one of the shaped charges of FIGS. 2 or 3 including the current carrying conductor and an associated exploding foil "bubble activated" initiator.

FIG. 9 illustrates a section of the current carrying conductor of FIG. 8 taken along section lines 9—9 of FIG. 8;

DETAILED DESCRIPTION OF THE PREFERRED EMBODIMENT

Figure 1:
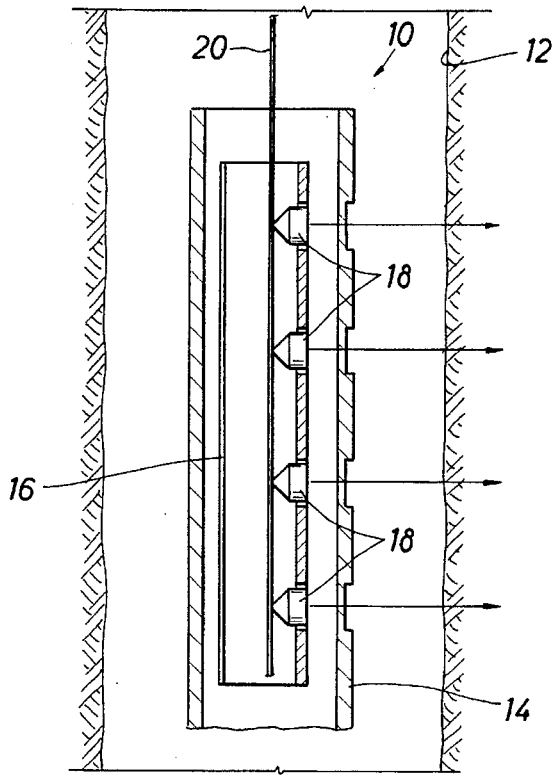
FIG. 1 illustrates a perforating gun disposed in a wellbore including a plurality of shaped charges connected to either a detonating cord or an electrical conductor.

Referring to FIG. 1, a perforating gun 10 is shown disposed in a wellbore 12. The perforating gun 10 includes a perforating gun carrier 14 in which a loading tube 16 is disposed. The loading tube 16 includes a plurality of phased mating holes, and a plurality of shaped charges 18 corresponding, respectively, with the plurality of phased mating holes. A conducting medium 20 is connected to the plurality of shaped charges 18, the conducting medium 20 conducting an energy package to each shaped charge for detonating the plurality of shaped charges 18. The conducting medium 20 may be an electrical current carrying conductor adapted for conducting an electrical current pulse, or it may be a detonating cord adapted for conducting a detonation wave.

Normally, the conducting medium 20 is a detonating cord and the energy package is a detonation wave, the detonating cord conducting the detonation wave to each shaped charge and the shaped charges detonating in response to the detonation wave. When the shaped charges detonate, a jet is produced from each charge. Since the conducting medium 20 in this case is a detonating cord, each shaped charge 18 must include a special initiator consisting of an explosive which responds to the detonation wave by producing the jet from each shaped charge 18.

However, it would be desirable to use a new conducting medium 20 for conducting a new energy package to the plurality of shaped charges 18. In that case, since the new energy package is conducting in the conducting medium 20, a new initiator must be used with each of the plurality of shaped charges. The new initiator responds to the new energy package conducting in the conducting medium by producing the jet from the shaped charges 18. The new conducting medium, the new energy package conducting in the new conducting medium 20, and the new initiator disposed within each shaped charge 18 is discussed below with reference to FIGS. 2–31 of the drawings.

Referring to FIGS. 2–9, an electrical current carrying conductor 20-1 is shown connected to the plurality of shaped charges 18 of a perforating apparatus 10. A plurality of exploding foil flying plate or bubble activated initiators (EFI initiators) 20*a* are mounted on the current carrying conductor 20-1. Exploding bridgewire initiators could also be used. The plurality of EFI initiators 20*a* are disposed in physical contact with an apex of the respective plurality of shaped charges 18 in accordance with the present invention.

Figure 2:
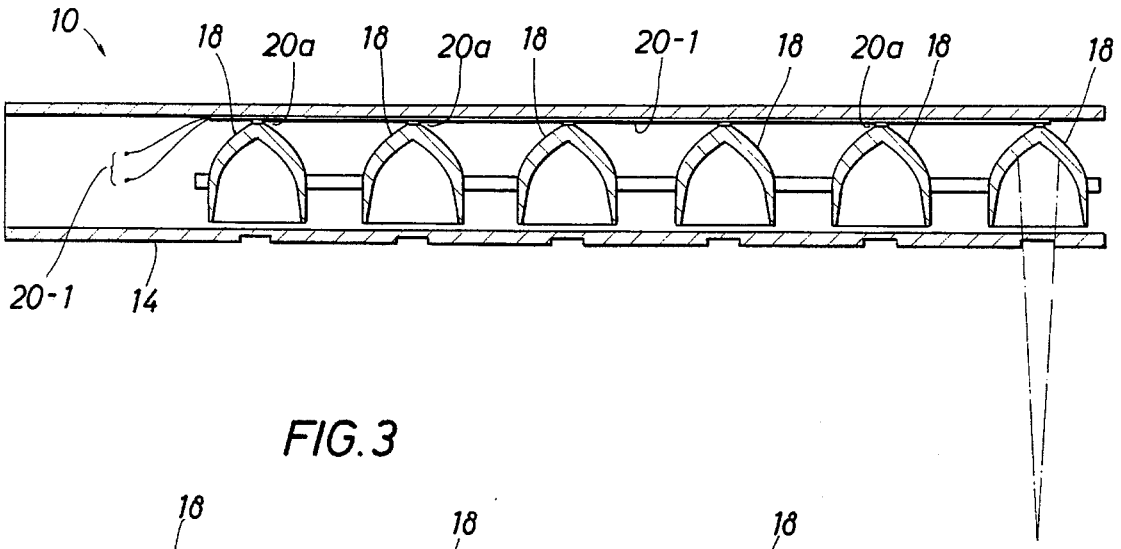
FIGS. 2–3 illustrate the plurality of shaped charges of FIG. 1 connected to an electrical current carrying conductor, each shaped charge including an initiator, such as an exploding foil flying plate initiator, or an exploding foil bubble activated initiator, or an exploding bridgewire initiator.

In FIG. 2, the perforating gun 10 of figure I is again shown including the plurality of shaped charges 18 connected to the conducting medium 20 which, in this case, comprises an ordinary electrical current carrying conducting wire 20-1. The current conducting wire 20-1 of FIG. 2 is physically attached to the inside of the perforating gun carrier 14, and each of the plurality of shaped charges 18 is electrically connected to the current conducting wire 20-1. As will be shown in detail in FIGS. 3–9, a plurality of exploding foil or exploding bridgewire initiators 20*a* are mounted on the conducting wire 20-1 and are disposed in contact with an apex of their respective plurality of shaped charges 18. The electrical initiators 20*a* are responsive to an ordinary electrical current conducting within the conducting wire 20-1 for producing a jet from each of the shaped charges 18.

The electrical initiators 20*a* of FIG. 2 are known as an exploding foil initiators (EFI initiators) 20*a*. There are three types of exploding foil initiators: an exploding foil 'flying plate' initiator, an exploding foil 'bubble activated' initiator, and an exploding bridge wire initiator. As shown in FIGS. 3–9, an exploding foil flying plate initiator 20*a*, or an exploding foil bubble activated initiator 20*a*, or an exploding bridgewire initiator is disposed between each shaped charge of the perforating apparatus and the current carrying conductor 20-1.

Figure 3:
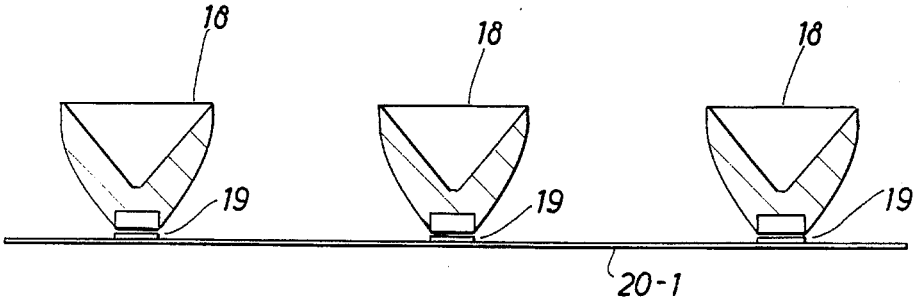

In FIG. 3, the conducting medium 20 of FIG. 1 comprises an electrical current carrying conductor wire 20-1 for carrying an electrical current. A plurality of barrels 19 are disposed, respectively, between the plurality of shaped charges 18 and the current carrying conductor 20-1. As shown in the following figures of drawing, the current carrying conductor wire 20-1 includes a first copper foil having a plurality of EFI initiators 20*a*, a second copper foil connected to ground potential, and a plurality of polyimide insulating layers.

In FIG. 4, the current carrying conductor wire 20-1 includes a first copper foil 20-1(*a*), having a plurality of EFI initiators 20*a* disposed thereon, located between a first polyimide layer 20*b* and a second polyimide layer 20*c*. A second copper foil 20*d* is disposed between the second polyimide layer 20*c* and a third polyimide layer 20*e*. The polyimide layers 20*b*, 20*c*, and 20*e* are approximately 0.025 inches in thickness. One type of polyimide material, which may be used as the polyimide layers 20*b*, 20*c*, and 20*e*, is known as "Kapton". The Kapton polyimide material is manufactured by E.I. Dupont De Nemours, Incorporated (Dupont). The first copper foil 20-1(*a*) functions as a current carrying conductor for carrying electrical current to each of the plurality of EFI initiators 20*a* and ultimately to each of the plurality of charges 18. The second copper foil 20*d* functioning as a return path for the current to ground potential.

In FIG. 5, a section of the current carrying conductor 20-1 of FIG. 4, taken along section lines 5—5 of FIG. 4, is illustrated. In FIG. 5, the first copper foil 20-1(*a*) is shown disposed over the second polyimide layer 20*c*. The first copper foil 20-1(*a*) includes a plurality of EFI initiators 20*a* spaced apart along the surface of the first copper foil, and each EFI initiator 20*a* on the first copper foil 20-1(*a*) includes a first part 20*a*2, a bridge 20*a*1, and a second part 20*a*3. If the width of the copper foil 20*a* is "W", each bridge 20*a*1 has a width "w", where the width "w" is much less than the width "W". As a result, in response to a current "I" of sufficient magnitude and duration flowing through the bridges 20*a*1, the bridges 20*a*1 will vaporize, creating an open circuit and producing a plasma gas directly above each bridge. The second copper foil 20*d* does not include any such bridges 20*a*1, the width of the second copper foil 20*d* being of constant width "W".

Referring to FIGS. 6 and 7, a 'flying plate' type of exploding foil initiator 20*a* is used with each of the shaped charges 18 of the perforating gun of FIG. 2. In FIG. 6, one of the barrels 19 is shown disposed between one of the shaped charges 18 and the current carrying conductor 20-1 (which embodies the flying plate initiator 20*a*) of the perforating gun of FIG. 2.

In FIGS. 6 and 7, a flying plate 20*b*1 in FIG. 6 is shown "flying" within a hole 19*a* in the barrel 19. The hole 19*a* of barrel 19 is disposed directly above the bridge 20*a*1 of FIG. 7 of the first copper foil 20-1(*a*). The flying plate 20*b*1 is actually a part of the first polyimide layer 20*b*, the flying plate 20*b*1 being a disc which was sheared off from the first polyimide layer 20*b* when a current "I" of sufficient magnitude flowed through the EFI initiator 20*a* of the first copper foil 20-1(*a*) of FIG. 7 and vaporized the bridge 20*a*1 of the EFI initiator 20*a* of the first copper foil 20*a* producing the plasma gas. A flying plate detonator is shown and discussed in U.S. Pat. No. 4,788,913 to Stroud et al, entitled "Flying Plate Detonator using a High Density High Explosive", the disclosure of which is incorporated by reference into this specification. A functional description of the operation of a shaped charge 18 of the perforating gun of FIG. 2 including an exploding foil flying plate initiator for use in connection with the shaped charge 18 of the perforating gun is set forth in the following pargraphs with reference to FIGS. 6 and 7 of the drawings.

In FIG. 6, assume a current "I" is flowing in the first copper foil 20-1(*a*). The current "I" is not a transient current, but is a direct current of sufficient time duration and magnitude to vaporize, approximately simultaneously, all of the bridges 20*a*1 of the EFI initiator 20*a* of the first copper foil 20-1(*a*) of FIG. 5. When the plurality of bridges 20*a*1 associated with each of the plurality of EFI initiators 20*a* vaporize, a corresponding plurality of high pressure plasma gas is produced. This plurality of high pressure gas associated with the plurality of bridges 20*a*1 produces a corresponding plurality of turbulence areas, and the plurality of turbulence areas are disposed directly under a plurality of portions of the first polyimide layer 20b. The plurality of portions of the first polyimide layer 20b are, in turn, disposed directly under the plurality of holes 19a associated with a respective plurality of barrels 19. As a result of these turbulence areas, a plurality of discs (the flying plate 20b1) are sheared off from the first polyimide layer 20b, the discs being forced to fly within the holes 19a of barrels 19. Therefore, in FIG. 6, the "flying plate" 20b1 is shown flying within hole 19a of barrel 19. The shaped charges 18 each include a secondary explosive pellet 18a, the pellet 18a being an HE pellet. Eventually, the flying plate 20b1 will impact the secondary explosive (HE pellet) portion 18a of the shaped charge 18. When this occurs, the secondary explosive pellet 18a detonates thereby detonating the shaped charge 18 and forming a jet which projects from the shaped charge and perforates a formation traversed by the wellbore, as shown in FIG. 1. As shown in FIG. 7, when the bridge 20a1 of the EFI initiator 20a of the first copper foil 20-1(*a*) vaporizes, an open circuit condition occurs. As a result, a first part of first copper foil 20a2 is physically and electrically disconnected from a second part of the first copper foil 20a3.

Referring to FIGS. 8 and 9, a 'bubble activated' type of exploding foil initiator is used with each of the shaped charges 18 of the perforating gun of FIG. 2. In FIG. 8, one of the barrels 19 is disposed between one of the shaped charges 18 and the current carrying conductor 20-1 (which embodies the exploding foil 'bubble activated' initiator 20a) of the perforating gun of FIG. 2.

In FIG. 8, a bubble 20b2 is shown expanding within a hole 19a in the barrel 19. The hole 19a of barrel 19 is disposed directly above the bridge 20a1 of the first copper foil 20-1(*a*). The bubble 20b2 is actually a part of the first polyimide layer 20b, the bubble 20b2 forming from the first polyimide layer 20b when a current "I" of sufficient magnitude flows through the EFI initiator 20a of the first copper foil 20-1(*a*) and vaporizes the bridge 20a1 of the EFI initiator 20a of the first copper foil 20-1(*a*). The bubble activated initiator is discussed in detail in U.S. Pat. No. 5,088,413 to Huber et al, entitled "Method and Apparatus for Safe Transport Handling Arming and Firing of Perforating Guns using a Bubble Activiated Detonator", the disclosure of which is incorporated by reference into this specification.

A functional description of the operation of the shaped charge 18 of the perforating gun of FIG. 2 including an exploding foil bubble activated initiator for use in connection with the shaped charge 18 of the perforating gun is set forth in the following pargraphs with reference to FIGS. 8 and 9 of the drawings.

In FIGS. 8 and 9, assume a current "I" is flowing in the first copper foil 20-1(*a*). The current "I" is not a transient current, but is a direct current of sufficient time duration and magnitude to vaporize, approximately simultaneously, all of the bridges 20a1 of the EFI initiators 20a on the first copper foil 20-1(*a*) of FIG. 5. When one of the bridges 20a1 vaporize, a plasma gas is produced, the plasma gas producing a turbulence directly under that portion of the first polyimide layer 20b which is disposed directly under the hole 19a of the barrel 19. As a result of this turbulence, a bubble 20b2 is formed from the first polyimide layer 20b, the shape and size of the bubble 20b2 being controlled by the shape and size of the hole 19a of barrel 19. Therefore, in FIG. 8, the bubble 20b2 is shown expanding within hole 19a of barrel 19. The shaped charges 18 each include a secondary explosive (HE pellet) portion 18a. Eventually, the bubble 20b2 will impact the secondary explosive pellet 18a of the shaped charge 18. When this occurs, the secondary explosive pellet 18a detonates thereby detonating the shaped charge 18 and forming a jet which projects from the shaped charge and perforates a formation traversed by the wellbore, as shown in FIG. 1. As shown in FIG. 9, when the bridges 20a1 of the EFI initiators 20a of the first copper foil 20-1(*a*) vaporize, an open circuit condition occurs with each bridge 20a1. As a result, as shown in FIG. 9, since each of the bridges 20a1 of the EFI initiators 20a are now open circuited, a first part 20a2 of the EFI initiators 20a of the first copper foil is physically and electrically disconnected from a second part 20a3 of the EFI initiator 20a of the first copper foil.

As a result, when the conducting medium 20 of FIG. 1 is an electrical current carrying conductor, such as the current carrying conductor wire 20-1 of FIG. 4, and when an exploding foil flying plate or bubble activated initiator of the type described above with reference to FIGS. 3–9 is used to detonate the shaped charges 18, and when a current of sufficient magnitude and time duration flows in the first copper foil 20-1(*a*) of conductor 20-1, the exploding foil flying plate or bubble activated initiators 20a will simultaneously detonate, and the simultaneous detonation of the EFI initiators 20a will, in turn, simultaneously detonate all of the shaped charges 18 of the perforating gun 10 of FIGS. 1 and 2.

Figure 10:
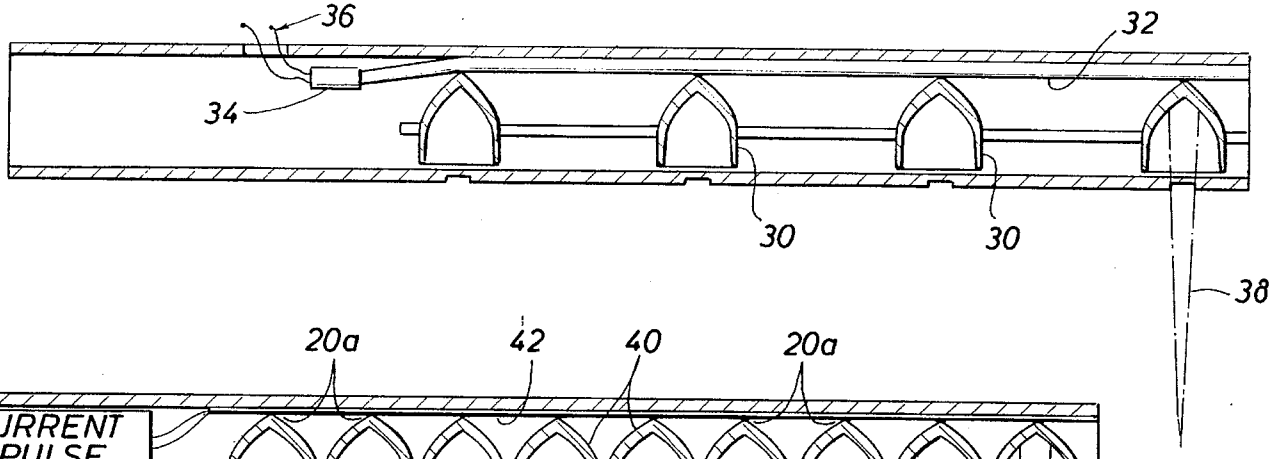
FIG. 10 illustrates a conventional perforating gun having shaped charges which are connected to a conventional detonating cord.

Referring to FIG. 10, a conventional perforating gun is illustrated. The conventional perforating gun includes a plurality of shaped charges 30 connected to a detonating cord 32. A detonator 34 initiates the propagation of a detonation wave in the detonating cord 32 in response to a current propagating in the electrical conductor 36. The detonation wave detonates the shaped charges thereby producing a jet 38 from each of the shaped charges 30.

Figure 11:
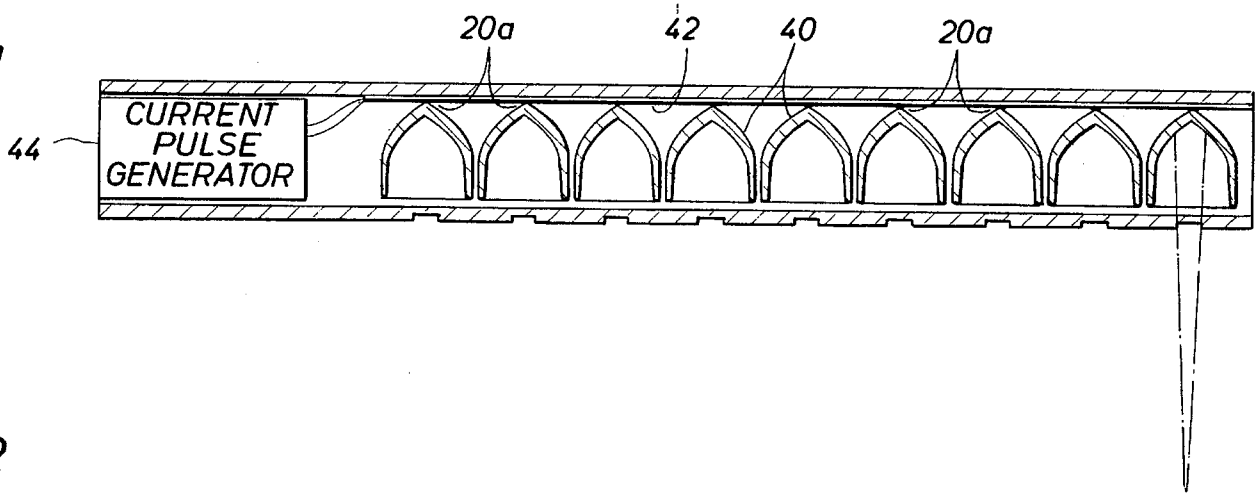
FIG. 11 illustrates a perforating gun having shaped charges which are connected to an electrical conductor in the form of a foil strip which is longitudinally disposed within the perforating gun connected to each shaped charge and energized by a current pulse from, for example, a compressed magnetic flux (CMF) current pulse generator.

Referring to FIG. 11, a new perforating gun in accordance with the present invention, similar to the new perforating gun of FIG. 2, is illustrated. The new perforating gun of FIG. 11 includes a plurality of shaped charges 40 connected to an electrical current carrying conductor 42. As will be discussed later in this specification, the conductor 42 includes a plurality of initiators 20a, such as an exploding foil flying plate initiator 20a of FIGS. 6–7 or an exploding foil bubble activated initiator 20a of FIGS. 8–9 or an exploding bridgewire initiator. The plurality of initiators 20a on the conductor 42 are disposed, respectively, adjacent to the plurality of shaped charges 40 for simultaneously detonating all of the charges in response to a simultaneous detonation of the plurality of initiators 20a. The conductor 42 is electrically connected to a current pulse generator 44. As will be noted later in this specification, the current pulse generator 44 can be either a charging capacitor circuit, or a parallel-connected charging capacitor circuit, or a compressed magnetic flux (CMF) current pulse generator.

Figure 12:
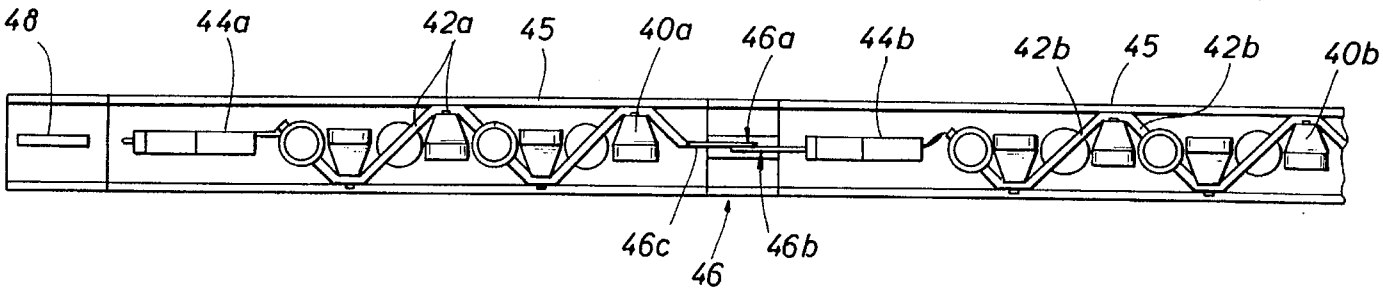
FIG. 12 illustrates a perforating gun having a first plurality of shaped charges which are connected to a first electrical conductor in the form of a foil strip which is helically wrapped around the perforating gun in a manner which allows the plurality of initiators of the foil strip to abut against their respective plurality of shaped charges, the first electrical conductor being energized by a current pulse from a first compressed magnetic flux (CMF) generator, and a second electrical conductor also in the form of a foil strip helically wrapped around the gun and energized by a second CMF generator.

Referring to FIG. 12, a preferred embodiment of the new perforating gun of FIG. 11 in accordance with the present invention is illustrated.

In FIG. 12, a first plurality of phased shaped charges 40a are disposed on one side of the new perforating gun. A first electrical current carrying flat cable conductor 42a (hereinafter, the "flat cable conductor 42a") is helically wrapped around the plurality of shaped charges 40a. The flat cable conductor 42a is shown to be wrapped around the plurality of shaped charges 40a within the interior of the loading tube 45 of the new perforating gun of FIG. 12, although the flat cable conductor 42a could just as easily be wrapped around the plurality of shaped charges 40a and around the exterior of the loading tube 45 of the new perforating gun of FIG. 12. The flat cable conductor 42*a* contacts the apex of each of the first plurality of shaped charges 40*a*. The flat cable conductor 42*a* is approximately 1.25 inches in width. The flat cable conductor 42*a* is a flat electrical current carrying conductor and it includes a plurality of initiators 20*a* spaced apart at periodic intervals along the length of the flat cable conductor 42*a*. When the flat cable conductor 42*a* is wrapped around the plurality of shaped charges 40*a*, the plurality of initiators 20*a* on the flat cable conductor 42*a* abut, respectively, against the apex of the first plurality of shaped charges 40*a*. The flat cable conductor 42*a* is electrically connected to a first current pulse generator 44*a* for generating a pulse of current which approximately simultaneously detonates the plurality of initiators 20*a* on the flat cable conductor 42*a*. The first current pulse generator 44*a* is actually a compressed magnetic flux (CMF) current pulse generator 44*a* (hereinafter called the "first CMF current pulse generator 44*a*"). The first CMF current pulse generator 44*a* receives a detonation wave from a detonator 48 and generates a current pulse in response to the detonation wave. The detonator 48 can be any typical detonator, such as a percussion detonator, an electric detonator, or an exploding foil initiator detonator, or an exploding bridgewire initiator detonator.

However, in addition, a second plurality of phased shaped charges 40*b* are disposed on the other side of the new perforating gun of FIG. 12. A second electrical current carrying flat cable conductor 42*b* (hereinafter, the flat cable conductor 42*b*) is helically wrapped around the plurality of charges 40*b* and within the interior of the loading tube 45 on the other side of the new perforating gun of FIG. 12, although the flat cable conductor 42*b* could just as easily be wrapped around the plurality of charges 40*b* and around the exterior of the loading tube 45. The flat cable conductor 42*b* contacts the apex of each of the second plurality of shaped charges 40*b*. The flat cable conductor 42*b* is a flat electrical current carrying conductor. As a result, the flat cable conductor 42*b* also includes a plurality of initiators 20*a* spaced at periodic intervals along the length of the flat cable conductor 42*b*. The initiators 20*a* can be the flying plate initiator, the bubble activated initiator, or the exploding bridgewire initiator. When the flat cable conductor 42*b* is wrapped around the plurality of shaped charges 40*b*, the plurality of initiators 20*a* on the flat cable conductor 42*b* abut, respectively, against the apex of the second plurality of shaped charges 40*b*. The flat cable conductor 42*b* is electrically connected to a second current pulse generator 44*b* which is actually a second compressed magnetic flux (CMF) current pulse generator 44*b*.

The first and second CMF current pulse generator 44*a* and 44*b* are each described in an article entitled "Small Helical Flux Compression Amplifiers", by J. E. Cover, O. M. Stuetzer, and J. L. Johnson, of Sandia Laboratories, Albuquerque, N. Mex., printed in Megagauss Physics and Technology, 1979, the disclosure of which is incorporated by reference into this specification.

An intermediate adaptor 46 separates the one side of the new perforating gun from the other side and functions to convert an electrical current pulse in the end of the first cable 42*a* into a detonation wave which initiates the generation of a current pulse from the second CMF current pulse generator 44*b*. The intermediate adaptor 46 includes an EFI firing head 46*c* connected to the end of the first flat cable conductor 42*a*. The EFI firing head 46*c* is identical to the EFI firing head 124 which is discussed below with reference to FIG. 23 of the drawings. The EFI firing head 46*c* functions to receive the current pulse propagating in the end of the first flat cable conductor 42*a* and to detonate an explosive pellet disposed within the firing head 46*c*. The intermediate adaptor 46 further includes a first detonating cord 46*a* connected to the EFI firing head 46*c* and responsive to the detonation of the explosive pellet in the EFI firing head 46*c* for initiating the propagation of a detonation wave in the first detonating cord, and a second detonating cord 46*b* disposed in side-by-side abutment with the first detonating cord 46*a*. In operation, when the current pulse propagating in the end of the first flat cable conductor 42*a* energizies the EFI firing head 46*c*, an explosive pellet in the firing head 46*c* detonates, which, in turn, initiates the propagation of a detonation wave in the first detonating cord 46*a*. Since the second detonating cord 46*b* is disposed in side-by-side abutment with the first detonating cord 46*a*, the detonation wave in the first detonating cord 46*a* transfers to the second detonating cord 46*b*. Therefore, a detonation wave now propagates in the second detonating cord 46*b*, and this detonation wave energizes the second CMF generator 44*b*. As a result, the second CMF generator 44*b* generates a second current pulse in response thereto.

A functional description of the operation of the new perforating gun of FIG. 12 will be set forth in the following paragraph with reference to FIG. 12 of the drawings.

The first CMF current pulse generator 44*a* receives a detonation wave from the detonator 48 and generates a current pulse in response therto. The current pulse propagates through the flat cable conductor 42*a* thereby detonating, approximately simultaneously, all of the initiators 20*a* disposed on the flat cable conductor 42*a*. Since the initiators 20*a* on the flat cable 42*a* abut, respectively, against the first plurality of shaped charges 40*a*, when the initiators on the flat cable conductor 42*a* simultaneously detonate, the first plurality of shaped charges 40*a* also detonate approximately simultaneously. The intermediate adaptor 46 converts the current pulse in the flat cable conducotr 42*a* into a second detonation wave. As a result, in response to the second detonation wave, the second CMF current pulse generator 44*b* generates a second current pulse. The second current pulse propagates through the flat cable conductor 42*b* thereby detonating, approximately simultaneously, all of the initiators disposed on the flat cable conductor 42*b*. Since the initiators on the flat cable conductor 42*b* abut, respectively, against the apex of the second plurality of shaped charges 40*b*, when the initiators on the flat cable conductor 42*b* detonate simultaneously, the second plurality of shaped charges 40*b* also detonate approximately simultaneously.

Referring to FIGS. 13–16, a detailed construction of the first electrical current carrying flat cable conductor 42*a* and the second electrical current carrying flat cable conductor 42*b* of FIG. 12 is illustrated.

Since the first and second flat cable conductors 42*a* and 42*b* are flat, ribbon like cables, they each have two sides, an external side which does not abut the apex of a shaped charge and an internal side which does abut the apex of the shaped charge. In accordance with a preferred embodiment of the present invention, a plurality of exploding foil (flying plate, or bubble activated, or exploding bridgewire) initiators 20*a*, similar to the EFI initiators 20*a* on the first copper foil 20-1(*a*) shown in FIGS. 4 and 5, are disposed on the internal side of the flat cables 42*a* and 42*b*, and they are spaced apart at periodic intervals along the internal side of the cable 42*a* and 42*b*. The external side of the flat cables 42*a* and 42*b* is shown in FIG. 13 and the internal side of the flat cables 42*a* and 42*b* is shown in FIG. 14.

Figure 13:
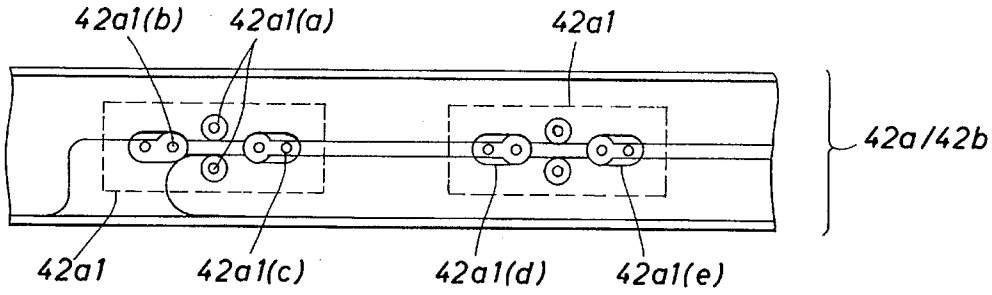
FIG. 13 illustrates an external view of the foil strip of FIG. 12.

In FIG. 13, a view of a portion of the external side of the first and second flat cable conductors 42*a* and 42*b* of FIG.

12 is illustrated. Since the external side of the flat cables face externally, the external side does not abut against the apex of any shaped charge 40 of FIG. 12. In FIG. 13, the external side of the flat cable conductors 42*a* and 42*b* includes a plurality of external initiator terminals 42*a*1. Since, in the preferred embodiment, an exploding foil (flying plate or bubble activated or exploding bridgewire) initiator (EFI) is the preferred type of initiator, hereinafter, each of the plurality of initiator terminals 42*a*1 will be referred to as "external EFI terminals 42*a*1". Each external EFI terminal 42*a*1 includes a pair of EFI attach holes 42*a*1(*a*), an EFI alignment hole 42*a*1(*b*), a charge jacket attachment hole 42*a*1(*c*), a ground relief 42*a*1(*d*), and a high voltage relief 42*a*1(*e*). In order to fully understand the construction of the "external" EFI terminal 42*a*1, it is necessary to understand the construction of the "internal" side of the flat cable conductors 42*a* and 42*b* of FIG. 12. Accordingly, refer to the FIG. 14 description below.

Figure 14:
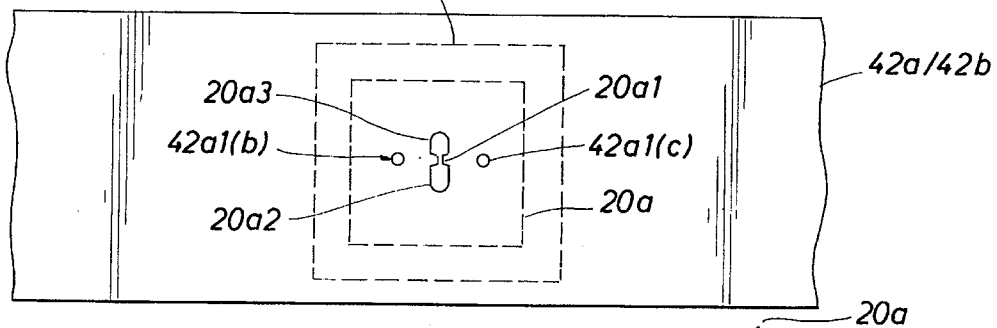
FIG. 14 illustrates an internal view of only one initiator of the plurality of parallel connected initiators which are disposed on the inside portion of the foil strip of FIG. 12.

Referring to FIG. 14, a view of a portion of the internal side of the first and second flat cable conductors 42*a* and 42*b* of FIG. 12 is illustrated. Since the flat cable conductors 42*a* and 42*b* of FIG. 12 each include a plurality of exploding foil initiators 20*a*, in FIG. 14, the construction of a single exploding foil initiator (EFI initiator) 20*a* (similar to the EFI initiator 20*a* of FIG. 5 which includes the the first part 20*a*2, the bridge 20*a*1, and the second part 20*a*3) is illustrated.

FIG. 14 actually illustrates a view of the external EFI terminal 42*a*1 of FIG. 13 from the "internal" side of the first and second flat cable conductors 42*a* and 42*b*. Recall from the above description in connection with FIGS. 6 and 7 that a flying plate 20*b*1 is sheared out from a first polyimide layer 20*b* when a bridge 20*a*1 of the EFI initiator 20*a* on a first copper foil 20-1(*a*) vaporizes in response to a current flowing from the first part 20*a*2 of the first copper foil 20-1(*a*), through the narrow bridge 20*a*1 of width "w", to the second part 20*a*3 of the first copper foil.

In FIG. 14, each of the exploding foil initiators 20*a*, disposed on the "internal" side of the first and second flat electrical current carrying cable conductors 42*a* and 42*b* of FIG. 12, includes a first part 20*a*2 (see FIG. 7) which is connected to one of the EFI attach holes 42*a*1(*a*) of FIG. 13 and a second part 20*a*3 which is connected to the other of the EFI attach holes 42*a*1(*a*) of FIG. 13. A bridge 20*a*1 (similar to bridge 20*a*1 of FIG. 7) is the narrow portion of the EFI initiator 20*a* which is electrically connected between the first part 20*a*2 of the EFI initiator 20*a* and the second part 20*a*3 of the EFI initiator 20*a*.

Figure 15:
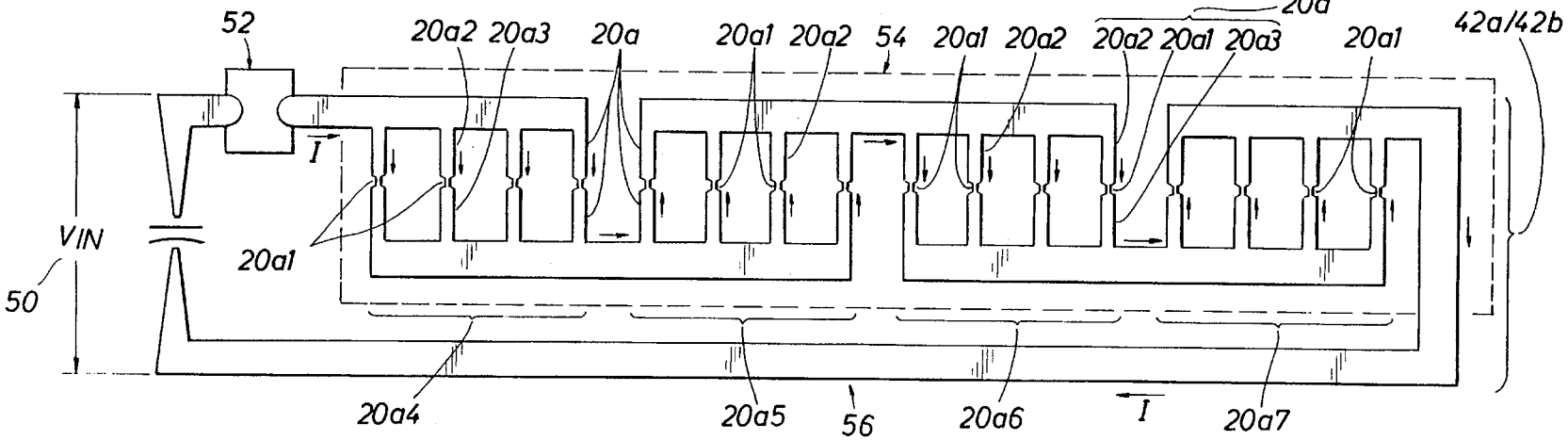
FIG. 15 illustrates the electrical current path which traverses all of the parallel connected initiators disposed on the interior or inside portion of the entire foil strip of FIG. 12.

Referring to FIG. 15, a view of the internal side of the first and second flat conductor cables 42*a* and 42*b* of FIG. 12 is illustrated.

FIG. 15 actually represents a view of the entire electrical current path which is disposed on the internal side of the first and second flat conductor cables 42*a* and 42*b* of FIG. 12 and which includes all of the parallel connected exploding foil (flying plate or bubble activated or exploding bridgewire) initiators.

Recall from the above description in connection with FIGS. 6–9 that an EFI initiator 20*a* is comprised of at least two layers: a first copper foil 20-1(*a*) for conducting a current, and a second copper foil 20*d* which functions to provide a return path for the current to ground potential. The first copper foil 20-1(*a*) of FIG. 6 conducts a current pulse through the bridge 20*a*1 of the EFI initiator 20*a* on the first copper foil 20-1(*a*), the bridge 20*a*1 separating the first part 20*a*2 of the first copper foil 20-1(*a*) 20*a*2 from the second part 20*a*3 of the first copper foil. Recall also that the second copper foil 20*d* functions as a ground potential providing a return path for the current flowing in the first copper foil 20-1(*a*).

In FIG. 15, an electrical current path associated with a plurality of parallel connected EFI initiators 20*a* disposed on the internal side of the flat cable conductors 42*a* and 42*b* is denoted by the element numeral 54. An electrical current path associated with the return path to ground potential is denoted by the element numeral 56. The electrical current path 54, including a plurality of parallel connected EFI initiators 20*a*, is connected to a voltage supply 50 via a spark gap switch 52. Note that the electrical current path 54 includes a first plurality of parallel connected exploding foil initiators 20*a*4 which receive a current from the voltage supply 50, a second plurality of parallel connected exploding foil initiators 20*a*5, a third plurality of parallel connected exploding foil initiators 20*a*6, and a fourth plurality of parallel connected exploding foil initiators 20*a*7. The first, second, third, and fourth plurality of exploding foil initiators 20*a*4–20*a*7 in FIG. 15 are each identical to the exploding foil initiator 20*a* shown in FIG. 14 of the drawings. As noted by the direction of the arrows in FIG. 15, the current from the voltage supply 50 flows through the electrical current path 54 as follows: in a first direction through the first plurality of initiators 20*a*4, then in a second direction opposite to the first direction through the second plurality of initiators 20*a*5, then in a third direction opposite to the second direction in the third plurality of initiators 20*a*6, and then in a fourth direction opposite to the third direction in the fourth plurality of initiators 20*a*7. The current from the fourth plurality of initiators 20*a*7 flows back to the voltage supply 50 via the return electrical current path 56 in FIG. 15. As a result, the first, second, third, and fourth plurality of exploding foil initiators 20*a*4, 20*a*5, 20*a*6, and 20*a*7 in FIG. 15 all detonate substantially simultaneously in response to the current pulse originating from the voltage supply 50 and flowing through all of the initiators.

Figure 16:
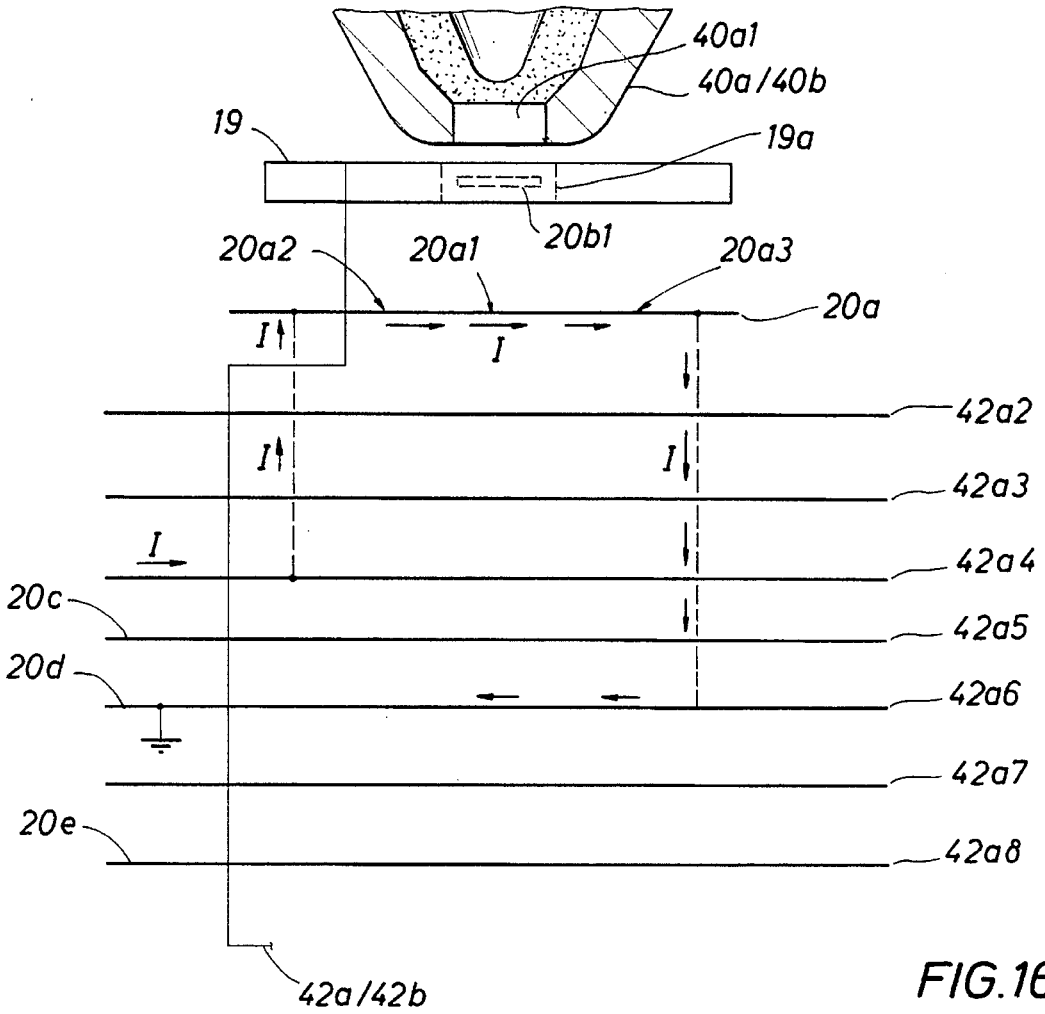
FIG. 16 illustrates a cross sectional view showing all of the individual layers which comprise the foil strip of FIGS. 12–15.

Referring to FIG. 16, a cross sectional view of the flat cable conductors 42*a* and 42*b*, including all of the individual layers of the first and second flat cables 42*a* and 42*b* of FIG. 12, is illustrated.

In FIG. 16, the flat cable conductors 42*a* and 42*b* of FIGS. 12, 13 and 15 each include: a two (2) Mil Kapton layer 42*a*2; an adhesive layer 42*a*3; a two (2) ounce copper layer 42*a*4 which conducts a current to the first copper foil 20-1(*a*) of FIGS. 6–9; a two (2) rail Kapton layer 42*a*5 which includes the second polyimide layer 20*c* of FIGS. 6–9; a two (2) ounce copper layer 42*a*6 which includes the second copper foil 20*d* return current path of FIGS. 6 and 8; an adhesive layer 42*a*7; a two (2) rail Kapton layer 42*a*8 which includes the third polyimide layer 20*e* of FIGS. 6 and 8; and a one (1) mil copper "EFI layer" 20*a*, disposed on top of the two rail Kapton layer 42*a*2, which is the EFI layer shown in FIG. 14 of the drawings and which includes the first part 20*a*2, the bridge 20*a*1, and the second part 20*a*3 of the first copper foil 20-1(*a*) shown in FIGS. 7 and 9 of the drawings. As shown in FIG. 6, a plate 20*b* 1 is sheared off from the first polyimide layer 20*b* in response to the current (I) flowing in the bridge 20*a*1 of the EFI layer 20*a* and the plate 20*b*1 flies through the hole 19*a* in the barrel 19 eventually impacting a secondary explosive pellet 40*a*1 of the shaped charges 40*a*/40*b* shown in FIG. 17 of the drawings.

Figure 17:
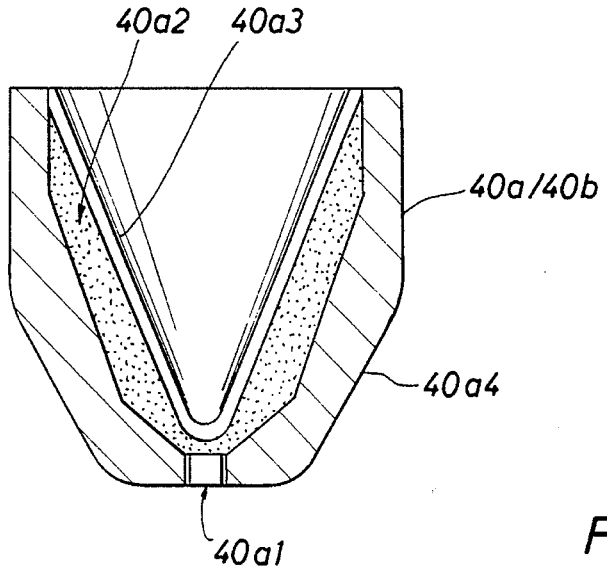
FIG. 17 illustrates a shaped charge which is used in connection with an exploding foil (flying plate or bubble activated) initiator or an exploding bridgewire initiator of the perforating guns of FIGS. 11, 12, and 26 where the shaped charge includes a pellet of secondary explosive which is responsive to a detonation of it's respective initiator for detonating the primary explosive in the shaped charge.

Referring to FIG. 17, a cross sectional view of the shaped charges 40*a* and 40*b* shown in FIG. 12 is illustrated.

The shaped charges 40*a* and 40*b* each include a metal liner 40*a*3, a metal case 40*a*4, a main body of high explosive 40a2 disposed between the metal liner 40a3 and the metal case 40a4, and a secondary explosive pellet 40a1 disposed in the apex of each shaped charge. The apex of each shaped charge is adapted to abut against the hole 19a of the barrel 19 of an EFI initiator 20a, as shown in FIG. 16, in a manner which guarantees that the hole 19a of the barrel 19 is disposed directly above and in direct alignment with the secondary explosive pellet 40a1 of the shaped charge 40a or 40b.

In accordance with another aspect of the present invention, the secondary explosive pellet 40a1 of the shaped charge 40a and 40b of FIG. 17 must be comprised of a special explosive composition which will detonate when the flying plate 20b1 of FIG. 6 impacts the pellet 40a1, or when the expanding bubble 20b2 of FIG. 8 impacts the pellet 40a1, or when a detonation wave in a detonating cord impacts the pellet 40a1. After extensive experimentation, it has been discovered that the special explosive composition of the secondary explosive pellet 40a1 must be selected from a group consisting of: HNS-IV, NONA, HMX, RDX, PETN, TATB, ABH, BTX, DPO, DODECA, Tripicryl-trinitrobenzene, barium styphnate, and metallic picrate salts. At low temperatures, for best performance, the secondary explosive pellet 40a1 should be selected from the following group: PETN, RDX, and HMX; however, at high temperatures, for best performance, the secondary explosive pellet 40a1 should be selected from the following group: ABH, BTX, DPO, NONA, DODECA, Tripicryl-trinitrobenzene, barium styphnate, and metallic picrate salts. However, the main body of explosive 40a2 can be selected from the following group: RDX, HMX, or HNS. One of the special explosive compositions disclosed in the above group will work in connection with some type of exploding foil initiator, or in connection with a semiconductor bridge initiator (of the type disclosed in U.S. Pat. No. 5,094,167 to Hendley Jr.), or in connection with some type of an exploding bridgewire initiator.

In the normal construction of a shaped charge, all explosives are pressed under a common load so that initiation sensitivity is not controlled independently from charge performance (higher pressing forces tend to desensitize the charge and cause misfires).

In accordance with still another aspect of the present invention, during manufacture of the shaped charge 40a and 40b of FIG. 17, the main body of explosive 40a2 is pressed independently of the pressing of the secondary explosive pellet 40a1. The main body of explosive 40a2 is pressed to a separate "high" density, but the secondary explosive pellet 40a1 is pressed to a separate "low" density. The "high" density of the main body of explosive 40a2 may be defined as that density which is above ninety percent (90%) of the theoretical maximum crystal density. The optimal "low" density of the "HNS IV" secondary explosive pellet 40a1, for example, would be 1.57 grams/cc. Recall that initiation of the pellet 40a1 must occur in response to detonation of either an EFI initiator 20a or a detonating cord. Pressing the pellet 40a1 to a separate low density relative to that of the main body of explosive 40a2 optimizes the initiation sensitivity of the secondary explosive pellet 40a1. The aforementioned optimized initiation sensitivity of the pellet 40a1 is required since the pellet must be initiated by detonation of either the EFI initiator 20a (which includes the Exploding Bridge Wire) or the detonating cord.

Referring to FIGS. 18–23, various embodiments of the current pulse generator 44 of FIG. 11 are illustrated.

Figure 18:
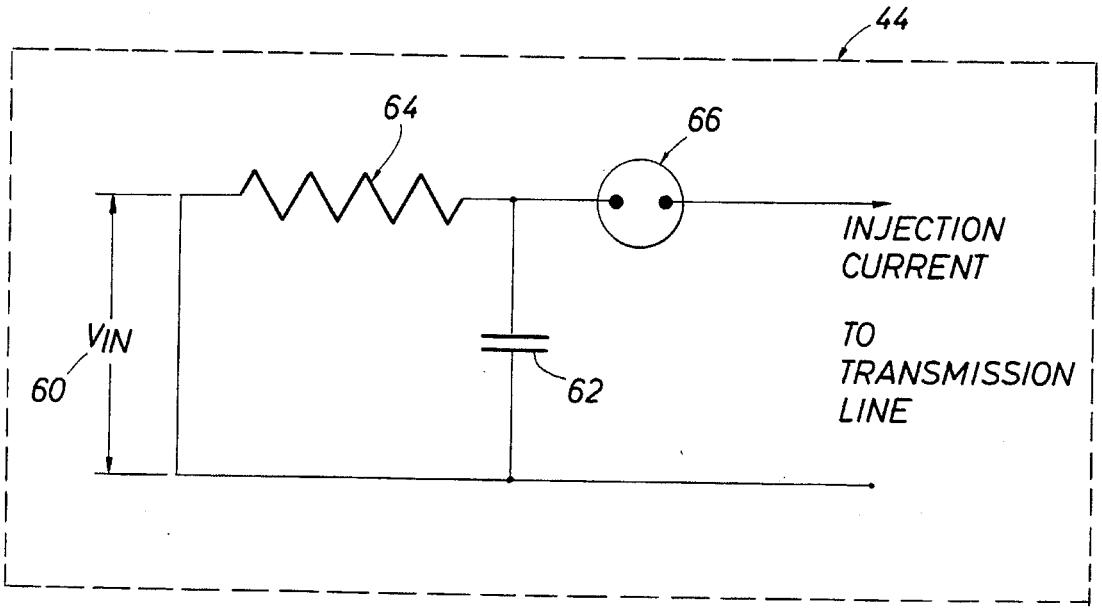
FIG.18 (PRIOR ART)
FIG. 18 illustrates a first embodiment of a prior art current pulse generator for generating a current pulse, where the current pulse energizes the flat cable conductor of FIGS. 12, 13, and 15 or the sheet of initiators of FIG. 27 and detonates the initiators.
Figure 19:
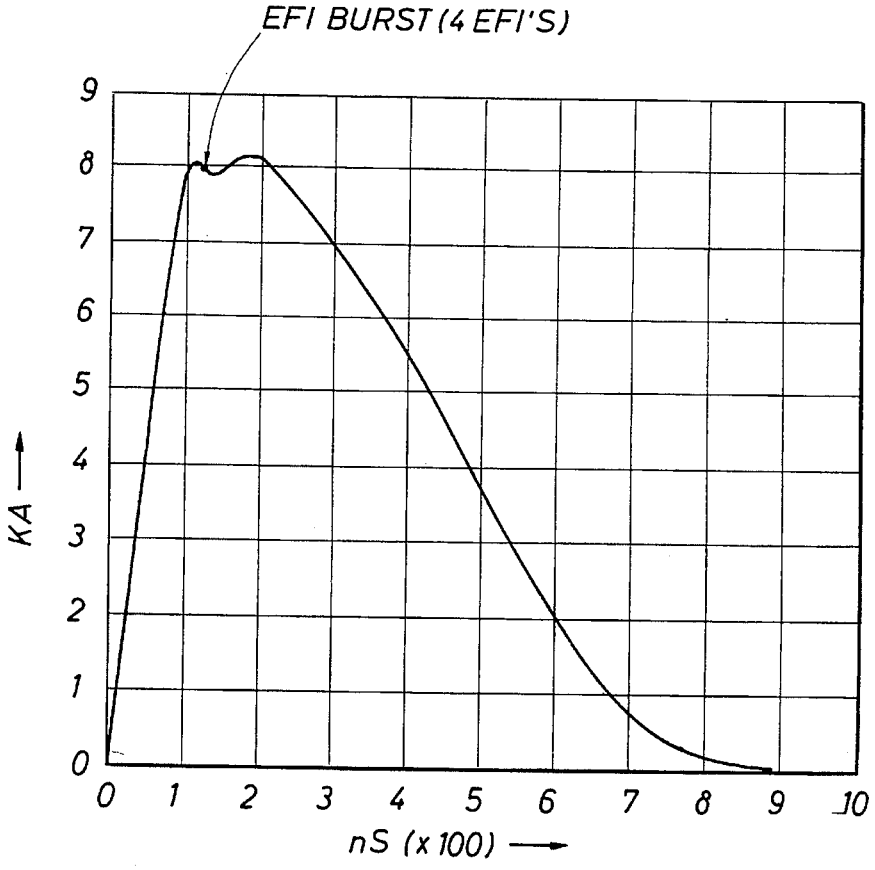
FIG. 19 illustrates a typical current pulse generated by the current pulse generator of FIG. 18.

In FIGS. 18 and 19, a first embodiment of the current pulse generator 44 of FIG. 11 is illustrated. The current pulse generator 44 can comprise a conventional charging capacitor and discharge swith arrangement. For example in FIG. 18, a high voltage source 60 is connected to a charging capacitor 62 via a charging resistor 64. The charging capacitor 62 is connected to a discharge switch 66. The voltage source 60 charges the capacitor 62. When the capacitor 62 is completely charged, the discharge switch 66 changes from a open circuit to a short circuit condition allowing a discharge current pulse stored in the form of a charge in the capacitor 62 to discharge through the short circuited discharge switch 66. The discharge current pulse (also known as an injection current) energizes the flat cable conductor 42 in FIG. 11 and flat cable 42a in FIG. 12.

FIG. 19 illustrates the exact nature of this discharge current pulse from the capacitor 62.

Figure 20:
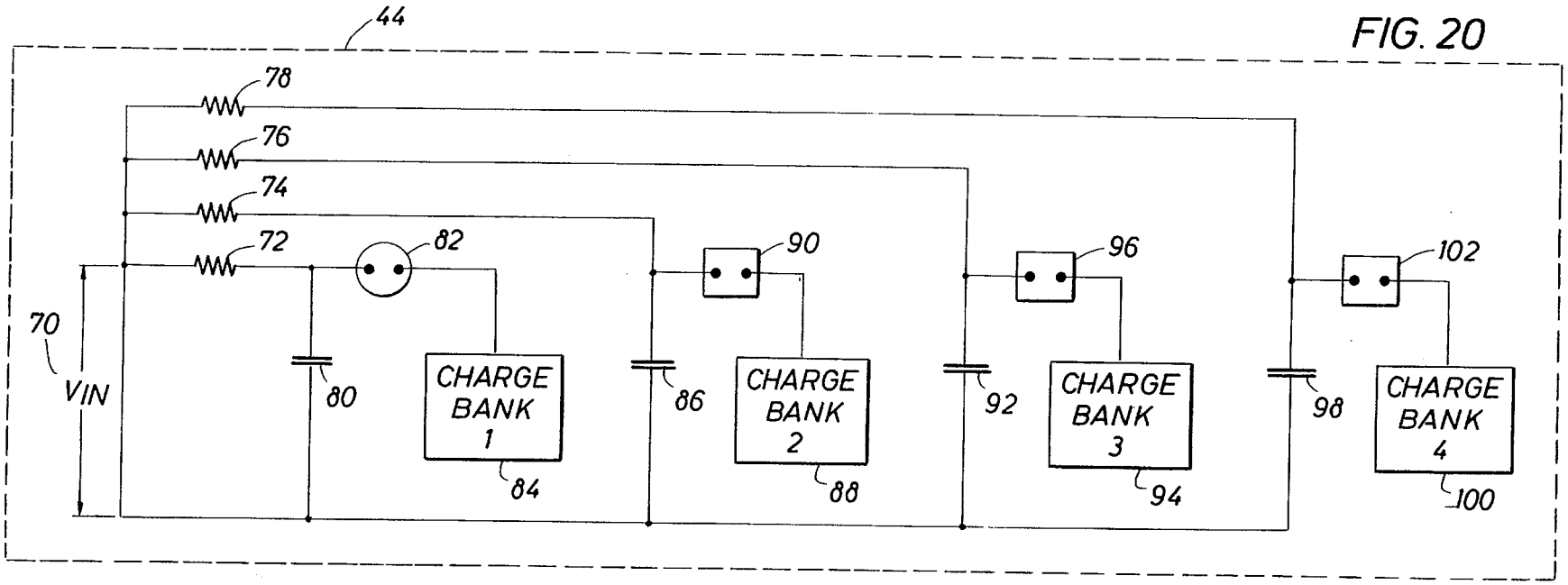
FIG. 20 illustrates a second embodiment of a current pulse generator.

In FIG. 20, a second embodiment of the current pulse generator 44 of FIG. 11 is illustrated.

In FIG. 20, the current pulse generator 44 could comprise a high voltage source 70 connected to a first charging resistor 72, a second charging resistor 74, a third charging resistor 76 and a fourth charging resistor 78. The first charging resistor 72 is connected to a first charging capacitor 80, and the first charging capacitor 80 is connected to a charge bank (1) 84 via a discharge switch 82. The charge bank (1) 84 comprises a first plurality of the shaped charges 40 of FIG. 11 of the perforating apparatus. The second charging resistor 74 is connected to a second charging capacitor 86, and the second charging capacitor 86 is connected to a charge bank (2) 88 via an explosive ionization gap 90. The charge bank (2) 88 comprises a second plurality of the shaped charges 40 of the perforating apparatus of FIG. 11. The third charging resistor 76 is connected to a third charging capacitor 92, and the third charging capacitor 92 is connected to a charge bank (3) 94 via an explosive ionization gap 96. The charge bank (3) 94 comprises a third plurality of the shaped charges 40 of the perforating apparatus of FIG. 11. The fourth charging resistor 78 is connected to a fourth charging capacitor 98, and the fourth charging capacitor 98 is connected to a charge bank (4) 100 via an explosive ionization gap 102. The charge bank (4) 100 comprises a fourth plurality of the shaped charges 40 of the perforating apparatus of FIG. 11. The charging capacitors are sized for about 0.3 uf times the number of charges it will fire. These capacitors are charged to a voltage of about 2 to 5 kV depending upon the length of the line and whether it will fire an EFI or an EBW initiator. In operation, the voltage source 70 charges the first charging capacitor 80. When the discharge switch closes it's circuit in response to the charge on the capacitor 80, a first discharge current flows from capacitor 80 to the charge bank (1) 84 thereby simultaneously detonating the first plurality of shaped charges. In the meantime, the voltage source 70 has already fully charged the other remaining charging capacitors, that is, the second, third, and fourth charging capacitors 86, 92, and 98. When the last charge of said first plurality of shaped charges of charge bank (1) 84 has detonated, the explosive ionization gap 90 allows a second discharge current to flow from the second charging capacitor 86 to the charge bank (2) 88 thereby simultaneously detonating the second plurality of shaped charges. When the last charge of said second plurality of shaped charges of charge bank (2) 88 has detonated, the explosive ionization gap 96 allows a third discharge current to flow from the third charging capacitor 92 to the charge bank (3) 94 thereby simultaneously detonating the third plurality of shaped charges. When the last charge of said third plurality of shaped charges of charge bank (3) 94 has detonated, the explosive ionization gap 102 allows a fourth discharge current to flow from the fourth charging capacitor 98 to the charge bank (4) 100 thereby simultaneously detonating the fourth plurality of shaped charges.

Figure 21:
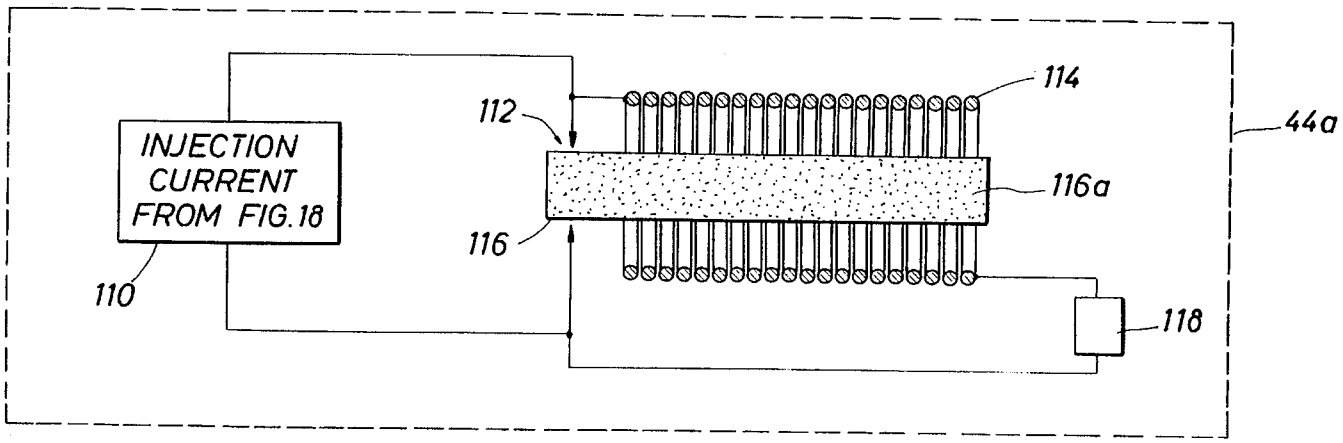
FIG. 21 (PRIOR ART)
FIG. 21 illustrates a third embodiment of a prior art current pulse generator including a CMF current pulse generator having a capacitor discharge input.

In FIG. 21, a third embodiment of the current pulse generator 44 of FIG. 11 is illustrated.

In FIG. 21, the current pulse generator 44 could comprise a compressed magnetic flux (CMF) current pulse generator. The CMF generator is described in an article entitled "Small Helical Flux Compression Amplifiers" by J. E. Gover, O. M. Stuetzer, and J. L. Johnson, Sandia Laboratories, Albuquerque, N. Mex., printed in "Megagauss Physics and Technology", 1979, the disclosure of which is incorporated by reference into this specification. The CMF generator is also described in an article entitled "The Central Power Supply", Showcase for Technology, conference and exposition, 1981, the disclosure of which is incorporated by reference into this specification. The CMF current pulse generator of FIG. 21 includes a source of injection or seed current 110, such as a capacitor discharge system which dumps energy from a capacitor into the inductance coil 114. The injection current source 110 is connected to a crow bar switch 112. The crow bar switch 112 is further connected to an inductance coil 114. An armature 116 os disposed within the center of the inductance coil 114. The armature 116 includes an explosive 116*a* which is detonated in response to a detonation wave from a detonating cord or a detonator. The last turn of the inductance coil 114 is connected to a load 118, such as the flat cable conductor 42*a* or the flat cable conductor 42*b* in FIG. 12 of the drawings. Recalling that the flat cable conductors 42*a* and 42*b* of FIG. 12 each include a plurality of the exploding foil (flying plate or bubble activated) initiators 20*a* shown in FIG. 14 of the drawings, the load 118 of FIG. 21 comprises a plurality of the exploding foil initiators 20*a* shown in FIG. 14. In operation, a current from the injection current source 110 is injected into the inductance coil 114. When the current in the coil 114 is near maximum, the explosive filled armature 116 is detonated from one end (e.g., from a detonating cord). The armature 116 begins to expand from one end (the left hand end in FIG. 21). As the armature 116 expands, the crow bar switch 112 is shorted out, and the coils of the inductance coil 114 are shorted out in sequence. Recall that, when the individual coils of the inductance coil 114 short out, since the magnetic field generated by the inductance coil 114 must remain constant, the current in the remaining coils of the inductance coil 114, which are not shorted out, must increase in amplitude thereby producing a pulse of current having an increasingly greater amplitude. Therefore, the current in the remaining coils of the inductance coil 114 increases in amplitude until it reaches a maximum in the last remaining coil of the inductance coil 114 which has not yet been shorted out by the expanding armature 116. The current in the last remaining coil of inductance coil 114 is typically 50 to 100 times the injection current from the injection current source 110. Thus, by selecting the correct number of turns of the inductance coil 114 and the injection current from injection current source 110, a sufficient output current can be obtained from the CMF current pulse generator 44 of FIG. 21 to fire several hundred initiators (EFI or EBW initiators) associated with several hundred shaped charges 40*a* or 40*b* of the perforating gun of FIG. 12.

Figure 22:
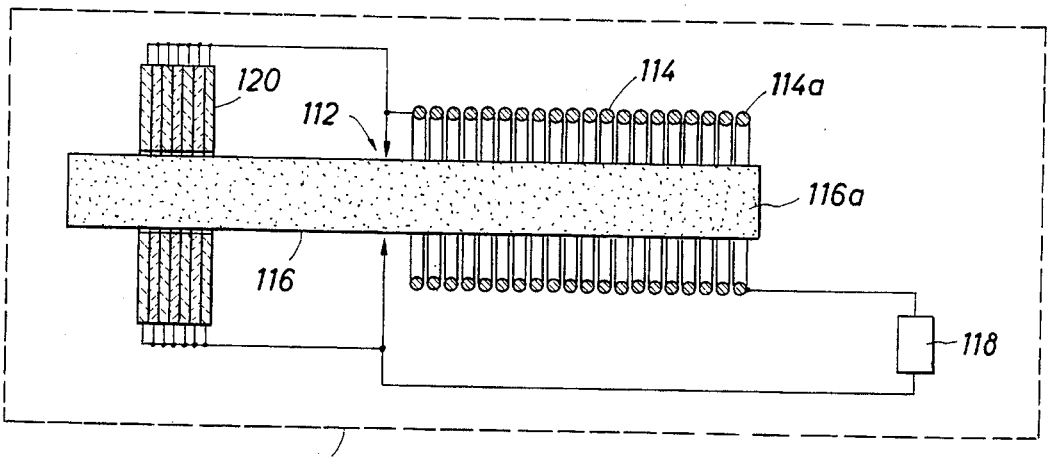
FIG. 22 (PRIOR ART)
FIG. 22 illustrates a fourth embodiment of a prior art current pulse generator including a CMF generator having a piezoelectric ceramic input.

In FIG. 22, a fourth embodiment of the current pulse generator 44 of FIG. 11 is illustrated.

FIG. 22 illustrates another embodiment of the compressed magnetic flux (CMF) current pulse generator shown in FIG. 21. However, in FIG. 22, instead of using the separate source of injection or seed current 110 shown in FIG. 21, a ferroelectric or piezoelectric ceramic or crystal 120, configured for a high output current and voltage, stores energy and therefore can be used as the source of injection current. The piezoelectric ceramic 120 encloses an armature 116 containing an explosive 116*a*, where the explosive 116*a* can be detonated by another exploding foil initiator, an exploding bridewire, or a standard electric detonator. In addition, a percussion detonator or a trigger charge booster activated by one of many available firing heads will detonate the explosive 116*a* in the armature 116. A crow bar switch 112 is connected to an inductance coil 114, the inductance coil 114 enclosing the armature. The last turn of the inductance coil 114 is connected to a load 118, which can be one of the plurality of exploding foil initiators 20*a* of FIG. 14 arranged on a flat conductor cable similar to flat cable 42*a* and 42*b* in FIG. 12. A certain spacing is chosen between the piezoelectric ceramic 120 and the inductance coil 114. This certain spacing must be used to allow the field in the coil 114 to build to near maximum before sequential shorting of the coil 114 commences. The certain spacing distance corresponds to the detonation velocity of the armature multiplied by the time required to charge the coil 114. The certain spacing distance is approximately 100 mm for a typical system but would vary depending upon the coil 114 size, inductance of the coil 114, and explosive type of the explosive 116*a*. In operation, the explosive 116*a* in the armature 116 is detonated by the detonator 48 of FIG. 12. Detonation of the explosive 116*a* produces an explosive shock in the armature 116. The explosive shock from the armature 116 releases the energy stored in the piezoelectric ceramic 120 and pumps the energy into the inductance coil 114. In response to the release of the energy from the piezoelectric ceramic 120, a current begins to flow from the ceramic 120 to the inductance coil 114. However, the armature explosive 116*a* has been detonated. As a result, the armature 116 expands in it's radial dimension, the expansion propagating from the left hand side of the armature 116 in FIG. 22 to the right hand side in FIG. 22. This propagating expansion of the armature 116 shorts out the crow bar switch 112, and then begins to short out each of the individual turns of the inductance coil 114, starting with the first turn of the coil 114 on the left hand side of the FIG. 22 and ending with the last turn on the right hand side of FIG. 22. Since the magnetic field produced by the coil 114 must remain constant, since the number of turns of the coil 114 which are not short circuited by the expanding armature is decreasing, the current in the remaining coil turns must increase to a maximum. When all turns of coil 114 are short circuited except for the last turn, the current in the last turn 114*a* has reached it's maximum value. This current in the last turn 114*a* is used to energize the load 118. As a result, all of the bridges 20*a*1 of all of the exploding foil initiators 20*a* or exploding bridgewire initiators on the flat cable 42*a* and 42*b* of FIG. 12 are substantially simultaneously vaporized.

Figure 23:
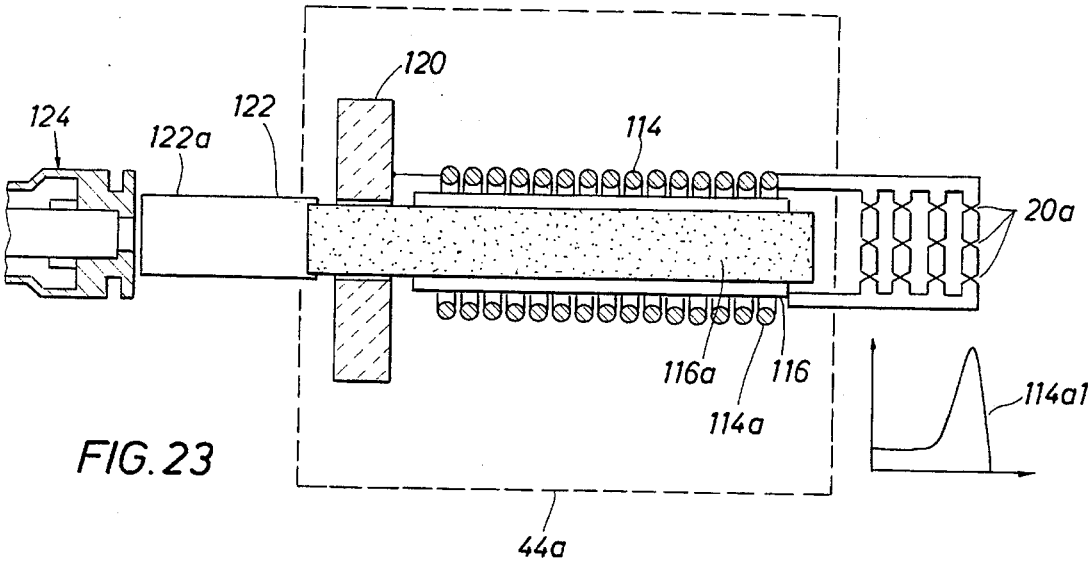
FIG. 23 illustrates the fourth embodiment of the current pulse generator of FIG. 22 which is connected to a plurality of parallel connected initiators, such as the exploding foil flying plate or bubble activated initiators or the exploding bridgewire initiators, on the perforating gun of FIGS. 11 and 12.

Referring to FIG. 23, the CMF generator 44 of FIG. 22 is again shown in FIG. 23. The output of the CMF generator 44 is shown connected to a plurality of the exploding foil initiators 20*a* of FIG. 14, where a first plurality of exploding foil initiators 20*a* is connected in parallel to a second plurality of such initiators 20*a*, the second plurality being connected in parallel to a third plurality of such initiators 20*a*, and the third plurality being connected in parallel to a fourth plurality of such initiators 20*a*. The explosive 116*a* in the armature 116 is detonated by a detonation wave propagating in a detonating cord 122. The detonating cord 122 has a booster 122*a* which is detonated by a firing head 124. The firing head 124 is discussed in U.S. Pat. No. 5,347,929, filed Sep. 1, 1993, entitled "Firing System for a Perforating gun Including an Exploding Foil Initiator and an Outer Housing for Conducting Wireline Current and EFI Current", the disclosure of which has already been incorporated by reference into this specification. The functional operation of the CMF generator in FIG. 23 is the same as that which is described above with reference to FIG. 22. However, the last turn 114*a* of the coil 114, which is not short circuited by the expanding armature 116, has a maximum pulse of current 114*a*1 flowing therein. This maximum pulse of current 114*a*1 substantially simultaneously detonates each of the exploding foil initiators 20*a* disposed on the surface of the flat cable conductor 42*a* and 42*b* of FIG. 12.

Referring to FIGS. 24–28, another embodiment of the present invention is illustrated. In this embodiment, instead of using a flat conductor cable 42*a* and 42*b* having a plurality of initiators disposed thereon, as shown in FIGS. 12–16, to detonate the plurality of shaped charges in a perforating gun as shown in FIG. 12, a sheet containing a plurality of initiators, adapted to wrap around the entire circumference of the perforating gun of FIG. 12, is utilized. When the sheet containing the plurality of initiators is wrapped around the entire circumference of the perforating gun of FIG. 12, each of the initiators on the sheet will abut against the apex of it's corresponding shaped charge for detonating the charge. The initiators on the sheet may each include an exploding foil (flying plate or bubble activated) initiator or an exploding bridgewire initiator.

Figure 24:
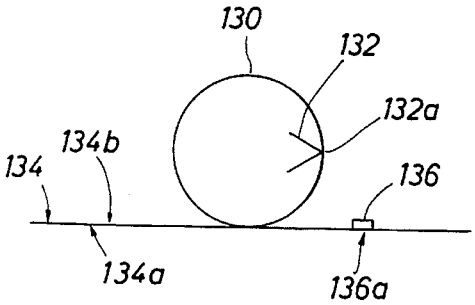
FIGS. 24–27 illustrate another embodiment of the present invention including a sheet of initiators which has a width, where, instead of using the flat cable conductor of FIGS. 12, 13, and 15, the sheet of initiators is wrapped around the entire circumference of the perforating gun of FIG. 12 until the width of the sheet is approximately equal to the circumference of the perforating gun.

In FIG. 24, a perforating gun 130 includes a shaped charge 132. In the actual embodiment, the perforating gun 130 includes a plurality of shaped charges 132. The perforating gun 130 is the same perforating gun as that which is shown in FIG. 12, except that the flat cable conductors 42*a* and 42*b* of FIG. 12 are each replaced by a sheet 134 containing a plurality of EFI initiators 20*a* as shown in FIGS. 24–28 (hereinafter called "the sheet of initiators"). In FIG. 24, the sheet of initiators 134 is shown laying flat before the sheet has been wrapped around the circumference of the perforating gun 130. The sheet 134 has an external side 134*a* and an internal side 134*b*, and, in FIG. 24, the sheet 134 includes an initiator 136. In the actual embodiment, the sheet 134 includes a plurality of initiators 134 corresponding, respectively, to the plurality of shaped charges 132 of the perforating gun 130. In the preferred embodiment, the initiator 136 is an exploding foil initiator 20*a* identical to the exploding foil initiator 20*a* shown in FIG. 14 of the drawings. The charge 132 includes an apex 132*a*.

Figure 25:
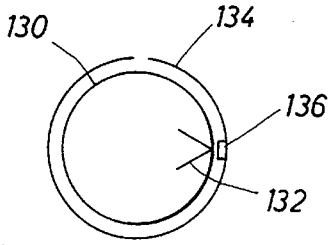

In FIG. 25, the sheet 134 has been wrapped around the entire circumference of the perforating gun 130 until the initiator 136 abuts against the apex 132*a* of the shaped charge 132.

Figure 26:
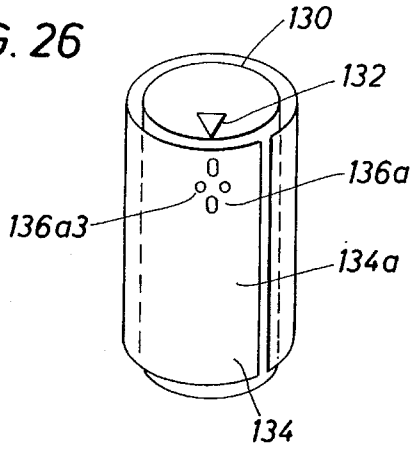

In FIG. 26, a three dimensional view of the perforating gun 130 of FIGS. 24–25 is illustrated. Since the width "W" of the sheet 134 (see FIG. 27) is approximately equal to the circumference of the perforating gun 130, the sheet of initiators 134 is physically wrapped around the entire circumference of the perforating gun 130 until the width "W" of the sheet 134 equals the circumference of the gun 130. The wrapping of the sheet 134 around the circumference of the gun 130 takes place in a manner which allows each of the plurality of EFI initiators 136 on the sheet to abut against the apex 132*a* of their respective shaped charges 132. As a result, when the initiator 136 detonates, the shaped charge 132 will detonate. The initiator 136 includes external initiator terminals 136*a* disposed on the external side surface of the sheet 134, similar to the external initiator terminals 42*a*1 shown in FIG. 13.

Figure 27:
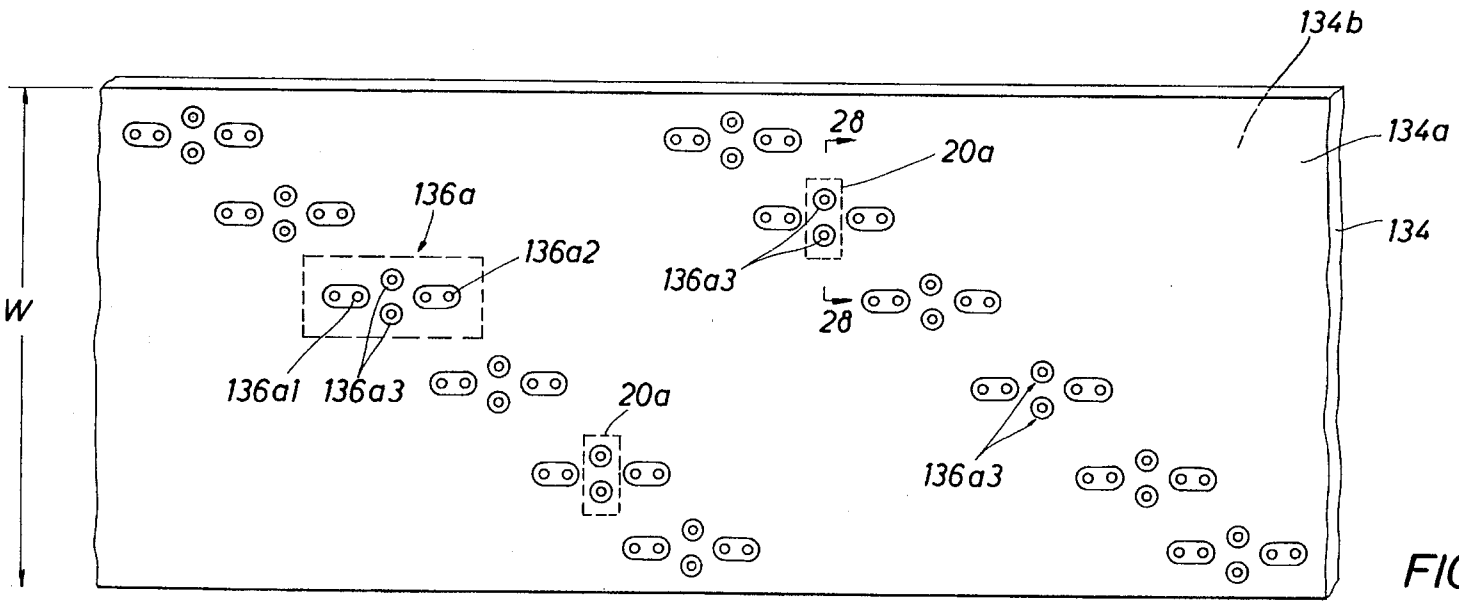

In FIG. 27, the external side 134*a* of the sheet of initiators 134 of FIG. 26 is shown laying flat on a surface and illustrating a plurality of the external initiator terminals 136*a*. In the preferred embodiment, the initiator 136 is an exploding foil initiator 20*a*, similar to the exploding foil initiator shown in FIG. 14 of the drawings. Therefore, the external initiator terminals 136*a* in FIG. 27 are terminals, disposed on the external side 134*a* of the sheet of initiators 134, associated with an exploding foil initiator 20*a*. Each of the external initiator terminals 136*a* include an EFI alignment hole 136*a*1, a charge jacket attachment hole 136*a*2, and a pair of EFI attach holes 136*a*3, similar to the alignment hole 42*a*1(*b*), attachment hole 42*a*1(*c*), and EFI attach holes 42*a*1(a) shown in FIG. 13 in connection with the flat cables 42*a* and 42*b*. The EFI attach holes 136*a*3 are first and second terminals, the first terminal of the EFI attach hole 136*a*3 being electrically connected to the first part 20*a*2 of the exploding loft initiator 20*a* of FIG. 14, the second terminal of the EFI attach hole 136*a*3 being electrically connected to the second part 20*a*3 of the exploding foil initiator 20*a* of FIG. 14.

Figure 28:
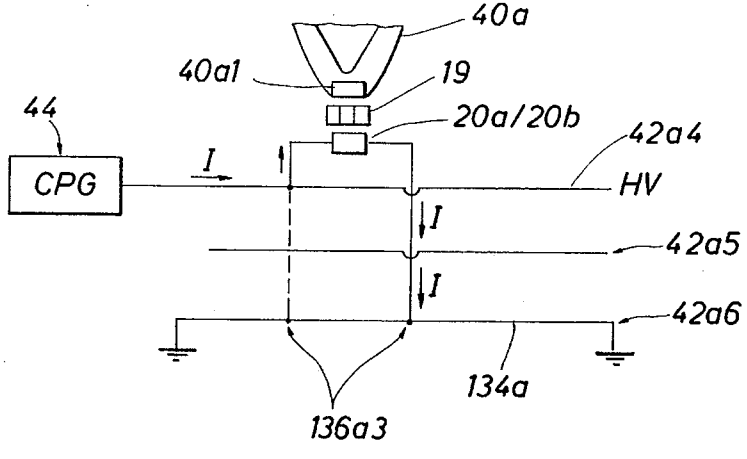
FIG. 28 illustrates a section of FIG. 27 taken along section lines 21—21 of FIG. 27.

FIG. 28 illustrates a partial cross-section of one of the exploding foil initiators 20*a* of FIG. 27 taken along section lines 28—28 of FIG. 27. In FIG. 28, the sheet of initiators 134, in cross section, has the same layers as that which is discussed above with reference to FIG. 16 of the drawings. However, for purposes of simplicity, in FIG. 28, only three layers of the sheet of initiators 134 is illustrated: a first two (2) ounce copper layer 42*a*4 which conducts a current to each of the plurality of exploding foil initiators 20*a*; a second two (2) mil Kapton layer 42*a*5 which represents the second polyimide layer 20*c* of FIGS. 6–9; and a third two (2) ounce copper layer 42*a*6 which represents the second copper foil 20*d* functioning as a return current path to ground potential in FIGS. 6 and 8. The exploding foil initiators 20*a*, being electrically connected to the first copper layer 42*a*4, is energized by a current conducting along the first copper layer 42*a*4 from the current pulse generator (CPG) 44 of FIG. 11, and it is also electrically connected to ground potential via the third copper layer 42*a*6. When the bridge 20*a*1 of the exploding foil initiator 20*a* vaporizes in response to the current from first copper layer 42*a*4, a flyer or bubble is formed from the first polyimide layer 20*b*, the flyer/bubble propagating through the hole 19*a* in barrel 19 thereby impacting the secondary explosive pellet 40*a*1 in shaped charge 40*a*. As noted above in the discussion with reference to FIG. 17, since the pellet 40*a*1 is comprised of the aforementioned special explosive composition, the pellet 40*a*1 detonates the shaped charge 40*a*.

Figure 29:
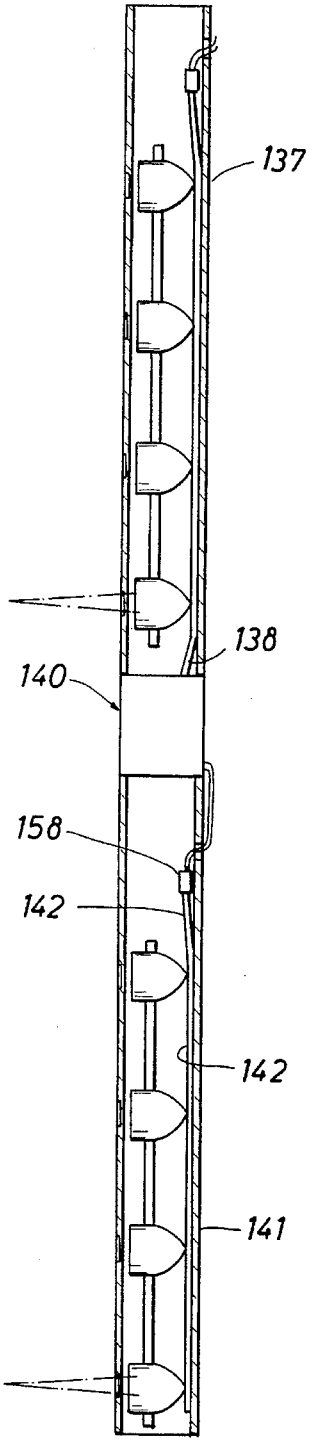
FIG. 29 illustrates a perforating apparatus including a first perforating gun, a second perforating gun, and a detonation transfer unit in accordance with another aspect of the present invention disposed between the first perforating gun and the second perforating gun for transferring a detonation wave from a first detonating cord of the first perforating gun to a second detonating cord of the second perforating gun of the perforating apparatus.

Referring to FIG. 29, a perforating apparatus is illustrated. This perforating apparatus includes a first perforating gun 137, a second perforating gun 141, and a detonation transfer unit 140 disposed between the first perforating gun 137 and the second perforating gun 141. A first detonating cord 138 is connected to and is associated with the first perforating gun 137. A second detonating cord 142 is connected to and is associated with the second perforating gun 141. A detonator 158 is connected to the second detonating cord 142. The detonator 158 may be an exploding foil initiator detonator, or an exploding bridgewire initiator detonator, or an electric detonator. The detonation transfer unit 140, which separates the first perforating gun 137 from the second perforating gun 141, is interconnected between the first detonating cord 138 and the detonator 158. A detailed construction of the detonation transfer unit 140 of FIG. 29 is discussed below with reference to FIG. 30 of the drawings.

Figure 30:
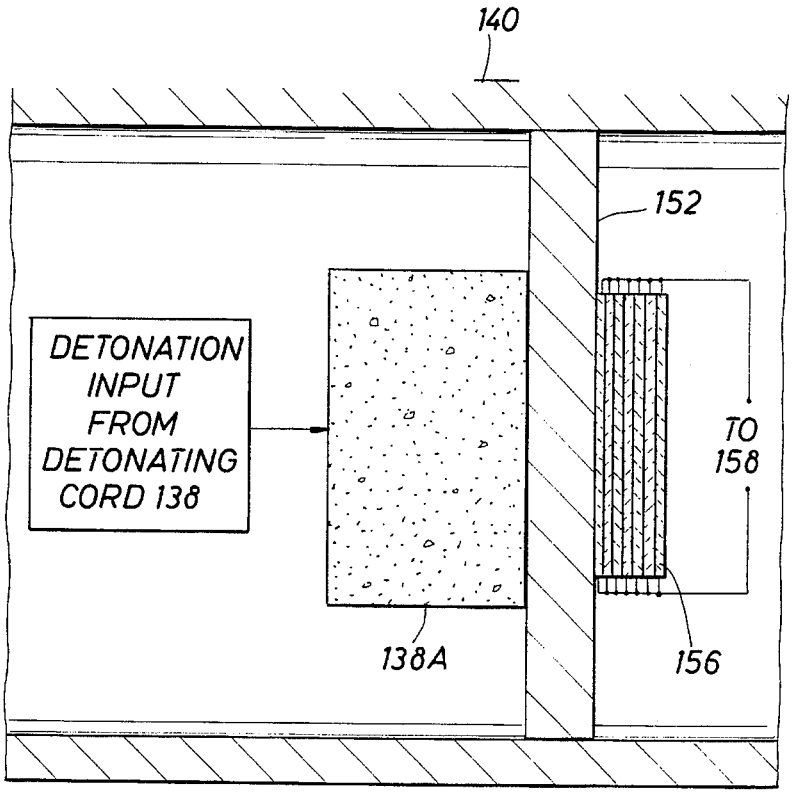
FIG. 30 (PRIOR ART)
FIG. 30 illustrates a more detailed construction of the detonation transfer unit of FIG. 29.

Referring to FIG. 30, a more detailed construction of the detonation transfer unit 140 of FIG. 29 is illustrated.

In FIG. 30, the detonation transfer unit 140 includes a pressure bulkhead 152 which is adapted to isolate and insulate the pressure which exists within the interior of the first perforating gun 137 from the pressure which exists within the interior of the second perforating gun 141. An end of the first detonating cord 138 of the first perforating gun 137 of FIG. 29 is disposed in abutment against one side of an explosive plane wave generator 138A, which is, in turn, disposed in abutment against one side of the pressure bulkhead 152. A ferroelectric or piezoelectric ceramic disc or crystal 156 is disposed in abutment against the other side of the pressure bulkhead 152. The piezoelectric ceramic 156 stores energy and is connected to the detonator 158 of FIG. 29 associated with the second detonating cord 142 of the second perforating gun 141 in FIG. 29. When a first detonation wave from the first detonating cord 138 hits the explosive planewave generator 138A, the resultant explosive plane wave is transferred through the bulkhead 152 to the piezoelectric ceramic 156 disposed on the other side of the bulkhead 152 thereby causing the energy stored in the piezoelectric ceramic 156 to dump into the detonator 158. As a result, a second detonation wave propagates from the detonator 158 into the second detonating cord 142 of the second perforating gun 141 of FIG. 29.

A functional description of the operation of the present invention is set forth in the following paragraphs with reference to FIG. 3 through FIG. 31 of the drawings.

This functional description will involve the perforating apparatus of FIG. 12, having the flat cable conductors 42*a* and 42*b* which helically wrap around the perforating apparatus in a manner which abuts against the apex of each shaped charge, and the perforating apparatus of FIG. 26, having the sheet of initiators 134 which wraps around the entire circumference of the perforating apparatus 130.

In FIG. 11, the current pulse generator 44 must generate a current pulse, similar to the current pulse shown in FIG. 19, in order to substantially simultaneously detonate the plurality of shaped charges 40 of the perforating apparatus in FIGS. 11 and 12. In the preferred embodiment, the current pulse generator 44 is the compressed magnetic flux (CMF) current pulse generator 44 shown in FIG. 23 of the drawings. Recall that the CMF generator 44 is described in a first article entitled "Small Helical Flux Compression Amplifiers" by J. E. Gover, O. M. Stuetzer, and J. L. Johnson, Sandia Laboratories, Albuquerque, N. Mex., printed in "Megagauss Physics and Technology", 1979, and in a second article entitled "The Central Power Supply", Showcase for Technology, conference and exposition, 1981, the first and second articles being incorporated by reference into this specification.

In FIG. 23, the exploding foil initiator (EFI) firing head 124 detonates the booster 112*a* of the detonating cord 122. Recall that the firing head 124 is described in U.S. Pat. No. 5,347,929, filed Sep. 1, 1993, entitled "Firing System for a Perforating gun Including an Exploding Foil Initiator and an Outer Housing for Conducting Wireline Current and EFI Current", the disclosure of which has been incorporated by reference into this specification. The detonating cord 122, in turn, detonates the explosive 116*a* of armature 116. The explosive detonation of the explosive 116*a* causes the piezoelectric ceramic 120 to release it's stored energy. As a result, a current begins to flow in the inductance coil 114. Detonation of the explosive 116*a* in the armature 116 causes the armature 116 to expand in it's diameter dimension, the expanded diameter propagating from left to right in FIG. 23. The expanded diameter of the armature 116 begins to short circuit the turns of the inductance coil 114, beginning with the left-most turn of the coil 114. The short circuit of coils 114 propagates from the left side of coil 114 to the right side in FIG. 23 until only one turn 114*a* of the coil 114 remains which is not short circuited. The magnetic field produced by the coil 114 must remain constant. Therefore, since the number of turns of the coil 114 is decreasing, the current in the remaining coils which are not short circuited must increase. As a result, a maximum pulse of current 114*a*1 flows in the one last remaining turn 114*a* of the inductance coil 114. This maximum pulse of current 114*a*1, shown in FIG. 23, flows into the plurality of initiators 20*a* in FIG. 23.

In FIG. 12, the maximum pulse of current flows from the CMF generator 44*a* into the flat cable conductor 42*a*.

In FIG. 15, when the spark gap switch 52 begins to conduct (changes from an open circuit to a dosed short circuit condition), this maximum pulse of current, from the last turn 114*a* of coil 114 of FIG. 23, flows on the internal side (the internal side being shown in FIG. 14) of the flat cable conductor 42*a* as follows: into the electrical current path 54 of FIG. 15, and begins to flow into the first plurality of parallel connected exploding foil initiators 20*a*4, then into the second plurality of parallel connected exploding foil initiators 20*a*5, then into the third plurality of parallel connected exploding foil initiators 20*a*6, then into the fourth plurality of parallel connected exploding foil initiators 20*a*7, and then into the return electrical current path 56 to ground potential. When this maximum pulse of current flows into the first plurality of parallel connected EFI initiators 20*a*4, it flows into first, second, third and fourth EFI initiators 20*a*.

In FIGS. 5 and 14, when the maximum pulse of current flows into an EFI initiator 20*a*, it first flows into the first part 20*a*2 of the EFI initiator 20*a*, then into the bridge 20*a*1, and then into the second part 20*a*3 of the EFI initiator 20*a*. When the maximum pulse of current flows through the bridge 20*a*1, the bridge 20*a*1 vaporizes producing a plasma gas which creates a turbulence in the region immediately above the bridge 20*a*1.

In FIGS. 6 and 8, in response to the turbulence produced in the region immediately above the bridge 20*a*1, in FIG. 6, a disc 20*b*1 is sheared out from the first polyimide layer 20*b*, the disc 20*b*1 flying through a hole 19*a* in the barrel 19 and impacting the secondary explosive pellet 18*a* in FIG. 6 (40*a*1 in FIGS. 16 and 17). When the disc impacts the pellet 18*a*, the shaped charge 18 in FIG. 6 (40*a* in FIG. 17) detonates. However, in FIG. 8, in response to the turbulence, a bubble 20*b*2 is formed from the first polyimide layer 20*b*, the bubble 20*b*2 impacting the secondary explosive pellet 18*a* (40*a*1 in FIGS. 16 and 17) thereby detonating the shaped charge 18 in FIG. 8 and 40*a* in FIG. 17.

When the last shaped charge 40*a* of the first perforating gun of the perforating apparatus of FIG. 12 detonates, the pulse of current conducting in the end of the first flat cable conductor 42*a* energizes the firing head 46*c* of the intermediate adaptor 46 of FIG. 12.

In FIG. 12, when the EFI firing head 46*c* receives the pulse of current conducting in the flat cable conductor 42*a*, a pellet in the firing head 46*c* detonates. Detonation of the pellet in the firing head 46*c* initiates the propagation of a first detonation wave in the first detonating cord 46*a* of the intermediate adaptor 46. Since the second detonating cord 46*b* of intermediate adaptor 46 is disposed in side-by-side abutment with the first detonating cord 46*a*, the first detonation wave in the first detonating cord 46*a* transfers to the second detonating cord 46b. Therefore, a second detonation wave now propagates in the second detonating cord 46b, and this detonation wave energizes the second CMF generator 44b. As a result, the second CMF generator 44b produces another maximum pulse of current, and that pulse of current propagates through the second flat conductor cable 42b in FIG. 12, detonating the plurality of shaped charges 40b of the second flat cable conductor 42b in the same manner as described above in connection with the first flat conductor cable 42a in FIG. 12.

Assume that the perforating gun in FIG. 12 does not use a flat conductor cable. Assume, instead, that a sheet of initiators, such as the sheet of initiators 134 shown in FIG. 26 of the drawings, is wrapped completely around the entire circumference of the perforating gun of FIG. 12. Based on that assumption, a functional description is set forth below with reference to FIGS. 23–28 of the drawings.

In FIG. 26, perforating gun 130 (the same gun as shown in FIG. 12 except the flat cable conductors 42a and 42b are not used) has a sheet of initiators 134 wrapped completely around the circumference of the perforating gun 130.

In FIG. 23, the CMF generator 44 produces the pulse of current 114a1 in the same manner described above in connection with the perforating gun of FIG. 12.

In FIG. 26, the pulse of current 114a1 flows into the sheet of initiators 134.

In FIG. 28, when the pulse of current 114a1 has flowed into the sheet of initiators 134, the current pulse 114a1 flows into the first two (2) ounce copper layer 42a4, into the EFI attach hole 136a3, and into the EFI initiator 20a. Recalling that the EFI initiator 20a includes the first part 20a2, the bridge 20a1, and the second part 20a3 (see FIG. 14), the pulse of current 114a1 flows through the first part 20a2, the bridge 20a1, the second part 20a3, into the EFI attach hole 136a3, and into the third two (2) ounce copper layer 42a6 to ground potential. The bridge 20a1 vaporizes producing a turbulence directly above the bridge 20a1 of the EFI initiator 20a. As noted in the above description, this turbulence either shears out a disc from the first polyimide layer 20b, the disc flying through the hole 19a in barrel (FIG. 6), or a bubble 20b2 is formed in the first polyimide layer 20b (FIG. 8), the bubble 20b2 impacting the secondary explosive pellet 18a/40a1 and detonating the shaped charge 18/40a.

As a result, when the pulse of current 114a1 enters the flat cable conductor 42a/42b of FIG. 12, or enters the sheet of initiators 134 of FIGS. 26 and 27, all of the initiators (whether they are EFI flying plate or bubble activated initiators 20a or exploding bridgewire initiators) on the flat cable 42a/42b or on the sheet of initiators 134 will detonate substantially simultaneously. In addition, since an electrical current carrying conductor is used to substantially simultaneously detonate a plurality of shaped charges in a perforating gun, detonating cords are no longer needed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for detonating one or more explosive devices, comprising:

current pulse generating means for generating a pulse of current;

current carrying conductor means electrically connected to said current pulse generating means and responsive to said pulse of current for conducting said pulse of current, said current carrying conductor means including a flat cable conductor;

one or more exploding foil initiator means electrically connected to said flat cable conductor and responsive to said pulse of current conducting in said flat cable conductor for detonating in response to said current, each of said one or more exploding foil initiator means on said flat cable conductor including a first conductor means for receiving said pulse of current and conducting said current, electrically conductive bridge means electrically connected to said first conductor means and disposed adjacent one of said one or more explosive devices for conducting said pulse of current and vaporizing in response to said current, and second conductor means electrically connected to said bridge means for receiving said said pulse of current from said bridge means and conducting said current, said bridge means of each of said one or more exploding foil initiator means on said flat cable conductor vaporizing in response to said current, each of said one or more initiator means detonating when said bridge means vaporizes; and a housing adapted for enclosing and holding said one or more explosive devices, said flat cable conductor being helically wrapped around said housing and being connected to said one or more explosive devices in said housing when said flat cable conductor is helically wrapped around said housing, said one or more exploding foil initiator means on said flat cable conductor means being disposed adjacent, respectively, said one or more explosive devices in said housing when said flat cable conductor means is helically wrapped around said housing, said one or more explosive devices in said housing detonating when said one or more exploding foil initiator means on said flat cable conductor detonates.

2. An apparatus for detonating one or more explosive devices, comprising:

current pulse generating means for generating a pulse of current;

current carrying conductor means electrically connected to said current pulse generating means and responsive to said pulse of current for conducting said pulse of current, said current carrying conductor means including a flat sheet having a length and a width;

one or more exploding foil initiator means electrically connected to said flat sheet and responsive to said pulse of current conducting in said conductor means for detonating in response to said current, each of said one or more exploding foil initiator means on said flat sheet including a first conductor means for receiving said pulse of current and conducting said current, electrically conductive bridge means electrically connected to said first conductor means and disposed adjacent one of said one or more explosive devices for conducting said pulse of current and vaporizing in response to said current, and second conductor means electrically connected to said bridge means for receiving said said pulse of current from said bridge means and conducting said current, said bridge means of each of said one or more exploding foil initiator means on said flat sheet vaporizing in response to said current, each of said one or more initiator means detonating when said bridge means vaporizes; and a housing adapted for enclosing and holding said one or more explosive devices, said flat sheet being wrapped around a circumference of said housing and being connected to said one or more explosive devices in said housing when said flat sheet is wrapped around said circumference of said housing, said one or more exploding foil initiator means on said flat sheet being disposed adjacent, respectively, said one or more explosive devices in said housing when said flat sheet is wrapped around said circumference of said housing, said one or more explosive devices in said housing detonating when said one or more exploding foil initiator means on said flat sheet detonates.

3. An apparatus for detonating one or more explosive devices, comprising:

current pulse generating means for generating a pulse of current;

current carrying conductor means electrically connected to said current pulse generating means and responsive to said pulse of current for conducting said pulse of current;

one or more exploding foil initiator means electrically connected to said conductor means and responsive to said pulse of current conducting in said conductor means for detonating in response to said current, said conductor means including a flat cable conductor, said flat cable conductor including said initiator means; and a housing adapted for enclosing and holding said one or more explosive devices, said current carrying conductor means being connected to said one or more explosive devices, said one or more exploding foil initiator means on said conductor means being disposed adjacent, respectively, said one or more explosive devices when said current carrying conductor means is connected to said one or more explosive devices, said one or more explosive devices in said housing detonating when said one or more exploding foil initiator means on said conductor means detonates.

4. An apparatus for detonating one or more explosive devices, comprising:

current pulse generating means for generating a pulse of current;

current carrying conductor means electrically connected to said current pulse generating means and responsive to said pulse of current for conducting said pulse of current;

one or more exploding foil initiator means electrically connected to said conductor means and responsive to said pulse of current conducting in said conductor means for detonating in response to said current, said conductor means including a flat sheet having a length and a width, said flat sheet including said initiator means; and a housing adapted for enclosing and holding said one or more explosive devices, said current carrying conductor means being connected to said one or more explosive devices, said one or more exploding foil initiator means on said conductor means being disposed adjacent, respectively, said one or more explosive devices when said current carrying conductor means is connected to said one or more explosive devices, said one or more explosive devices in said housing detonating when said one or more exploding foil initiator means on said conductor means detonates.

5. An apparatus for detonating one or more explosive devices, comprising:

current pulse generating means for generating a pulse of current, said current pulse generating means including compressed magnetic flux current pulse generating means including an armature having an explosive, an injection current source, and an inductance coil disposed around said armature and electrically connected to said injection current source adapted for producing said pulse of current;

current carrying conductor means electrically connected to said current pulse generating means and responsive to said pulse of current for conducting said pulse of current;

one or more exploding foil initiator means electrically connected to said conductor means and responsive to said pulse of current conducting in said conductor means for detonating in response to said current; and a housing adapted for enclosing and holding said one or more explosive devices, said current carrying conductor means being connected to said one or more explosive devices, said one or more exploding foil initiator means on said conductor means being disposed adjacent, respectively, said one or more explosive devices when said current carrying conductor means is connected to said one or more explosive devices, said one or more explosive devices in said housing detonating when said one or more exploding foil initiator means on said conductor means detonates.

6. An apparatus for detonating one or more explosive devices, comprising:

current pulse generating means for generating a pulse of current, said current pulse generating means including a voltage source, a charging capacitor, and a switch adapted to close connected to said charging capacitor, said capacitor generating said pulse of current when said switch closes;

current carrying conductor means electrically connected to said current pulse generating means and responsive to said pulse of current for conducting said pulse of current;

one or more exploding foil initiator means electrically connected to said conductor means and responsive to said pulse of current conducting in said conductor means for detonating in response to said current, said conductor means comprises a flat cable conductor, said flat cable conductor including said initiator means; and a housing adapted for enclosing and holding said one or more explosive devices, said current carrying conductor means being connected to said one or more explosive devices, said one or more exploding foil initiator means on said conductor means being disposed adjacent, respectively, said one or more explosive devices when said current carrying conductor means is connected to said one or more explosive devices, said one or more explosive devices in said housing detonating when said one or more exploding foil initiator means on said conductor means detonates.

7. An apparatus for detonating one or more explosive devices, comprising:

current pulse generating means for generating a pulse of current, said current pulse generating means including a voltage source, a charging capacitor, and a switch adapted to close connected to said charging capacitor, said capacitor generating said pulse of current when said switch closes;

current carrying conductor means electrically connected to said current pulse generating means and responsive to said pulse of current for conducting said pulse of current;

one or more exploding foil initiator means electrically connected to said conductor means and responsive to said pulse of current conducting in said conductor means for detonating in response to said current, said conductor means including a flat sheet having a length and a width, said flat sheet including said initiator means; and a housing adapted for enclosing and holding said one or more explosive devices, said current carrying conductor means being connected to said one or more explosive devices, said one or more exploding foil initiator means on said conductor means being disposed adjacent, respectively, said one or more explosive devices when said current carrying conductor means is connected to said one or more explosive devices, said one or more explosive devices in said housing detonating when said one or more exploding foil initiator means on said conductor means detonates.

8. A perforating gun, comprising:

a shaped charge adapted to detonate;

an electrical current carrying conductor connected to the shaped charge adapted for conducting a current, said conductor including a flat conductor cable helically wrapped around said shaped charge; and an initiator adapted to detonate interconnected between the conductor and the shaped charge, the initiator detonating in response to the current in the conductor, the shaped charge detonating in response to the detonation of the initiator.

9. A perforating gun, comprising:

a shaped charge adapted to detonate;

an electrical current carrying conductor connected to the shaped charge adapted for conducting a current, said conductor including a flat sheet conductor wrapped around said shaped charge; and an initiator adapted to detonate interconnected between the conductor and the shaped charge, the initiator detonating in response to the current in the conductor, the shaped charge detonating in response to the detonation of the initiator.

10. An apparatus for detonating a plurality of shaped charges, each of said charges having an apex, comprising:

current pulse generating means responsive to a stimulus for generating a pulse of current;

flat cable conductor means electrically connected to said current pulse generating means, helically wrapped around and in contact with said plurality of charges, and responsive to said pulse of current for conducting said pulse of current; and a plurality of exploding foil initiator means electrically connected to said conductor means, connected, respectively, to the apex of said plurality of charges, and responsive to said pulse of current conducting in said conductor means for substantially simultaneously detonating in response to said current, each of said plurality of exploding foil initiator means including, a first conductor means for receiving said pulse of current and conducting said current, electrically conductive bridge means electrically connected to said first conductor means and connected to the apex of one of said charges for conducting said current and vaporizing when said current exceeds a predetermined level, and second conductor means electrically connected to said bridge means for receiving said said pulse of current from said bridge means and conducting said current, said bridge means of said plurality of exploding foil initiator means substantially simultaneously vaporizing and changing from a short circuit to an open circuit condition in response to said current when said current exceeds said predetermined level, said plurality of shaped charges substantially simultaneously detonating when said bridge means of said plurality of initiator means substantially simultaneously change to said open circuit condition.

11. The apparatus of claim 10, wherein said current pulse generating means comprises compressed magnetic flux current pulse generating means including an armature having an explosive, an injection current source, and an inductance coil disposed around said armature and electrically connected to said injection current source adapted for producing said pulse of current.

12. The apparatus of claim 10, wherein said current pulse generating means comprises a voltage source, a charging capacitor, and a switch adapted to close connected to said charging capacitor, said capacitor generating said pulse of current when said switch closes.

13. An apparatus for detonating a plurality of shaped charges, each of said charges having an apex, comprising:

current pulse generating means responsive to a stimulus for generating a pulse of current;

flat sheet conductor means having a length and width, electrically connected to said current pulse generating means, wrapped completely around a circumference of said plurality of shaped charges until said width of said sheet conductor means is approximately equal to said circumference, disposed in contact with said plurality of charges, and responsive to said pulse of current from said current pulse generating means for conducting said pulse of current; and a plurality of exploding foil initiator means electrically connected to said flat sheet conductor means, connected, respectively, to the apex of said plurality of charges, and responsive to said pulse of current conducting in said conductor means for substantially simultaneously detonating in response to said pulse of current, each of said plurality of exploding foil initiator means including, a first conductor means for receiving said pulse of current and conducting said current, electrically conductive bridge means electrically connected to said first conductor means and connected to the apex of one of said charges for conducting said current and vaporizing when said current exceeds a predetermined level, and second conductor means electrically connected to said bridge means for receiving said said pulse of current from said bridge means and conducting said current, said bridge means of said plurality of exploding foil initiator means substantially simultaneously vaporizing and changing from a short circuit to an open circuit condition in response to said current when said current exceeds said predetermined level, said plurality of shaped charges substantially simultaneously detonating when said bridge means of said plurality of exploding foil initiator means substantially simultaneously change to said open circuit condition.

14. The apparatus of claim 13, wherein said current pulse generating means comprises compressed magnetic flux current pulse generating means including an armature having an explosive, an injection current source, and an inductance coil disposed around said armature and electrically connected to said injection current source adapted for producing said pulse of current.

15. The apparatus of claim 13, wherein said current pulse generating means comprises a voltage source, a charging capacitor, and a switch adapted to close connected to said charging capacitor, said capacitor generating said pulse of current when said switch closes.

16. An apparatus for detonating a plurality of shaped charges, said plurality of shaped charges including a first plurality of shaped charges and a second plurality of shaped charges, comprising:

current generating means responsive to a stimulus for generating a current;

a plurality of charging capacitor means electrically connected to said current generating means and responsive to said current for charging in response to said current; and a plurality of conductor means connected, respectively, to said plurality of charging capacitor means and responsive to said current for conducting said current, each said plurality of conductor means including a plurality of initiator means responsive to said current for detonating in response to said current, said first plurality of shaped charges detonating in response to detonation of said plurality of initiator means associated with a first one of said plurality of conductor means, said second plurality of shaped charges detonating in response to detonation of said plurality of initiator means associated with a second one of said plurality of conductor means.

17. The apparatus of claim 16, wherein each said plurality of conductor means comprises a flat conductor cable, said flat conductor cable including said plurality of initiator means.

18. The apparatus of claim 16, wherein each said plurality of conductor means comprises a flat sheet having a length and width, said flat sheet including said plurality of initiator means.

19. The apparatus of claim 16, wherein each said plurality of initiator means include exploding foil initiator means, each said exploding foil initiator means comprise:

first conductor means for receiving said pulse of current and conducting said current, bridge means electrically connected to said first conductor means for conducting said current and vaporizing when said current exceeds a predetermined level, and second conductor means electrically connected to said bridge means for receiving said said pulse of current from said bridge means and conducting said current, said bridge means vaporizing and changing from a short circuit to an open circuit condition in response to said current when said current exceeds said predetermined level, said first and second plurality of shaped charges detonating when said bridge means of the corresponding plurality of initiator means changes to said open circuit condition.

20. The apparatus of claim 19, wherein each said plurality of conductor means comprises a flat conductor cable, said flat conductor cable including said plurality of initiator means.

21. The apparatus of claim 19, wherein each said plurality of conductor means comprises a flat sheet having a length and width, said flat sheet including said plurality of initiator means.

22. A perforating apparatus adapted to detonate, comprising:

a plurality of shaped charges adapted to detonate, each of said charges having an apex;

current pulse generating means for generating a pulse of current;

electrical current carrying conductor means electrically connected to said current pulse generating means and each of said plurality of shaped charges for receiving said pulse of current from said current pulse generating means and conducting said pulse of current; and a plurality of exploding foil initiators interconnected, respectively, between the plurality of charges and said conductor means, each of the plurality of initiators including, first conductor means electrically connected to said conductor means for receiving said pulse of current from said conductor means and conducting said current, electrically conductive bridge means connected to said first conductor means and disposed directly adjacent the apex of one of said plurality of charges for receiving said current from said first conductor and conducting said current, and second conductor means connected to said bridge means for receiving said current from said bridge means and conducting said current, said bridge means of each of said plurality of inflators substantially simultaneously changing from a short circuit condition to an open circuit condition in response to said current conducting therein, said plurality of shaped charges substantially simultaneously detonating when said bridge means of said plurality of initiators substantially simultaneously change to said open circuit condition, said perforating apparatus detonating when said charges simultaneously detonate.

23. The perforating apparatus of claim 22, wherein said electrical current carrying conductor means comprises:

a flat conductor cable adapted to be helically wrapped around said plurality of shaped charges, said plurality of initiators being interconnected, respectively, between said plurality of charges and said flat conductor cable and being disposed adjacent to the apex of said plurality of charges when said flat conductor cable is helically wrapped around said plurality of charges.

24. The perforating apparatus of claim 22, wherein said perforating apparatus has a circumference, and wherein said electrical current carrying conductor means comprises:

a flat sheet having a width which is approximately equal to said circumference, said sheet being adapted to wrap around the entire circumference of said perforating apparatus, said plurality of initiators being interconnected, respectively, between said plurality of charges and said flat sheet and being disposed adjacent to the apex of said plurality of charges when said flat sheet is wrapped around the circumference of said perforating apparatus.

25. The perforating apparatus of claim 22, wherein said current pulse generating means comprises a compressed magnetic flux current pulse generating means, said compressed magnetic flux current pulse generating means include an armature including an explosive, an injection current source, and an inductance coil disposed around said armature and electrically connected to said injection current source adapted for producing said pulse of current.

26. The perforating apparatus of claim 25, wherein said electrical current carrying conductor means comprises:

a flat conductor cable adapted to be helically wrapped around said plurality of shaped charges, said plurality of initiators being interconnected, respectively, between said plurality of charges and said flat conductor cable and being disposed adjacent to the apex of said plurality of charges when said flat conductor cable is helically wrapped around said plurality of charges.

27. The perforating apparatus of claim 25, wherein said perforating apparatus has a circumference, and wherein said electrical current carrying conductor means comprises:

a flat sheet having a width which is approximately equal to said circumference, said sheet being adapted to wrap around the entire circumference of said perforating apparatus, said plurality of initiators being interconnected, respectively, between said plurality of charges and said flat sheet and being disposed adjacent to the apex of said plurality of charges when said flat sheet is wrapped around the circumference of said perforating apparatus.

28. The perforating apparatus of claim 22, wherein said current pulse generating means comprises a voltage source, a charging capacitor, and a switch adapted to close connected to said charging capacitor, said capacitor generating said pulse of current when said switch closes.

29. The perforating apparatus of claim 28, wherein said electrical current carrying conductor means comprises:

a flat conductor cable adapted to be helically wrapped around said plurality of shaped charges, said plurality of initiators being interconnected, respectively, between said plurality of charges and said flat conductor cable and being disposed adjacent to the apex of said plurality of charges when said flat conductor cable is helically wrapped around said plurality of charges.

30. The perforating apparatus of claim 28, wherein said perforating apparatus has a circumference, and wherein said electrical current carrying conductor means comprises:

a flat sheet having a width which is approximately equal to said circumference, said sheet being adapted to wrap around the entire circumference of said perforating apparatus, said plurality of initiators being interconnected, respectively, between said plurality of charges and said flat sheet and being disposed adjacent to the apex of said plurality of charges when said flat sheet is wrapped around the circumference of said perforating apparatus.

31. A method of detonating a perforating gun, said gun including a charge, comprising the steps of:

(a) conducting a current pulse in an electrical current carrying conductor, said conductor including an exploding foil initiator, said exploding foil initiator including a first part electrically connected to said conductor, an electrically conductive bridge electrically connected to said first part and disposed adjacent to an apex of said charge, and a second part electrically connected to said bridge and to said conductor;

(b) receiving said current pulse from said conductor into said first part of said exploding foil initiator;

(c) receiving said current pulse from said first part into said bridge;

(d) receiving said current pulse from said bridge into said second part;

(e) vaporizing said bridge and creating a turbulence in response to said current pulse; and (f) detonating said charge in response to said turbulence, said perforating gun detonating when said charge detonates.

32. The method of claim 31, wherein the conducting step (a) comprises the step of:

(g) transmitting said current pulse from a current pulse generator; and (h) receiving said current pulse from said current pulse generator into said electrical current carrying conductor, said current pulse conducting in said conductor when said current pulse is received therein.

33. The method of claim 32, wherein the transmitting step (g) comprises the step of:

detonating an explosive in an armature;

conducting a current in an inductive coil, said coil having turns; and sequentially shorting out the turns of said coil in response to the detonating step, said current pulse transmitted from said current pulse generator being the current in a last one of the turns of said coil which is not shorted out.

34. The method of claim 32, wherein the transmitting step (g) comprises the step of:

charging a charging capacitor; and closing a switch when the charging capacitor is charged, said capacitor discharging when the switch is closed, a discharge current flowing from the discharging capacitor, said current pulse transmitted from said current pulse generator being said discharge current.

35. A method of detonating a shaped charge, comprising the steps of:

(a) conducting a current pulse in an electrical current carrying conductor, said conductor including an exploding foil initiator, said exploding foil initiator including a first electrically conductive part electrically connected to said conductor, an electrically conductive bridge electrically connected to said first part and disposed adjacent to an apex of said charge, and a second electrically conductive part electrically connected to said bridge and to said conductor;

(b) receiving said current pulse from said conductor into the first part of said initiator;

(c) receiving said current pulse from said first part into said bridge;

(d) receiving said current pulse from said bridge into the second part;

(e) vaporizing said bridge and creating a turbulence in response to said current pulse; and (f) detonating said charge in response to said turbulence.

36. The method of claim 35, wherein the conducting step (a) comprises the step of:

(g) transmitting said current pulse from a current pulse generator; and (h) receiving said current pulse from said current pulse generator into said electrical current carrying conductor, said current pulse conducting in said conductor when said current pulse is received therein.

37. The method of claim 36, wherein the transmitting step (g) comprises the step of:

detonating an explosive in an armature;

conducting a current in an inductive coil, said coil having turns; and sequentially shorting out the turns of said coil in response to the detonating step, said current pulse transmitted from said current pulse generator being the current in a last one of the turns of said coil which is not shorted out.

38. The method of claim 36, wherein the transmitting step (g) comprises the step of:

charging a charging capacitor; and closing a switch when the charging capacitor is charged, said capacitor discharging when the switch is closed, a discharge current flowing from the discharging capacitor, said current pulse transmitted from said current pulse generator being said discharge current.

39. A method of manufacturing a perforating gun, comprising the steps of:

locating a plurality of shaped charges in a loading tube; and helically wrapping an electrically conductive current carrying conductor cable around the plurality of shaped charges, the cable being disposed in contact with the plurality of charges.

40. The method of claim 39, wherein said cable includes a plurality of initiators corresponding, respectively, to said plurality of charges, the wrapping step including the step of:

helically wrapping said cable around said charges in a manner which allows said plurality of initiators on said cable to contact said plurality of charges.

41. A method of manufacturing a perforating gun, comprising the steps of:

locating a plurality of shaped charges in a loading tube; and wrapping a sheet containing a plurality of initiators around a circumference of said loading tube in a manner which allows said plurality of initiaters of said sheet to contact said plurality of shaped charges.

42. In a perforating apparatus including a first perforating gun, a second perforating gun, and an intermediate adaptor disposed between said first perforating gun and said second perforating gun of a perforating apparatus, said intermediate adaptor comprising:

a housing;

a bulkhead disposed in contact with said housing and separating said adaptor into a first part and a second part;

an explosive located in said first part of said adaptor and disposed adjacent one side of said bulkhead;

a piezoelectric ceramic located in said second part of said adaptor and disposed in contact with the other side of said bulkhead; and a detonator electrically connected to said piezoelectric ceramic.

43. A system adapted to be disposed in a wellbore comprising:

an exploding initiator adapted to detonate; and a shaped charge adapted to detonate and including an apex, said apex being disposed adjacent said exploding initiator, said shaped charge detonating in response to a detonation of said exploding initiator, said shaped charge including, a liner;

a case;

a main body of explosive adapted to detonate and disposed between the liner and the case; and a secondary explosive adapted to detonate and disposed in said apex of said charge adjacent said main body of explosive, said secondary explosive being selected from a group consisting of HNS-IV, NONA, HMX, RDX, PETN, TATB, ABH, BTX, DPO, DODECA, Tripicryl-trinitrobenzene, barium styphnate, and metallic picrate salts, said secondary explosive detonating in response to detonation of said exploding initiator, said main body of explosive detonating in response to a detonation of said secondary explosive, said shaped charge detonating in response to detonation of said main body of explosive.

44. The shaped charge of claim 43, wherein the main body has a density, the secondary explosive has a density, the density of the secondary explosive being less than the density of the main body of explosive.

45. A perforating gun adapted to detonate, comprising:

a plurality of exploding initiators adapted to detonate; and a plurality of shaped charges disposed adjacent, respectively, said plurality of exploding initiators, each charge of the plurality of shaped charges having an apex and including, a liner;

a case;

a main body of explosive adapted to detonate and disposed between the liner and the case; and a secondary explosive adapted to detonate and disposed in said apex adjacent said main body of explosive, said secondary explosive being selected from a group consisting of HNS-IV, NONA, HMX, RDX, PETN, TATB, ABH, BTX, DPO, DODECA, Tripicryl-trinitrobenzene, barium styphnate, and metallic picrate salts, said secondary explosive of said plurality of shaped charges detonating in response to a detonation of said plurality of exploding initiators, said main body of explosive of said plurality of shaped charges detonating in response to the detonation of said secondary explosive of said plurality of shaped charges, said plurality of shaped charges detonating in response to the detonation of said main body of explosive of said plurality of shaped charges, said perforating gun detonating in response to detonation of said plurality of shaped charges.

46. A perforating gun adapted to detonate, comprising:

a plurality of exploding initiators adapted to detonate;

a plurality of shaped charges adapted to detonate and disposed adjacent, respectively, said plurality of exploding initiators, each charge of the plurality of shaped charges having an apex and including, a liner;

a case;

a main body of explosive adapted to detonate and disposed between the liner and the case; and a secondary explosive adapted to detonate and disposed in said apex of said charge adjacent said main body of explosive, said secondary explosive having a first density, said main body of explosive having a second density, the first density of said secondary explosive being less than the second density of said main body of explosive, said secondary explosive of said plurality of shaped charges detonating in response to detonation of said plurality of exploding initiators, said main body of explosive of said plurality of shaped charges detonating in response to detonation of said secondary explosive of said plurality of shaped charges, said plurality of shaped charges detonating in response to detonation of said main body of explosive of said plurality of shaped charges, said perforating gun detonating when said plurality of shaped charges detonate.

47. A system adapted to be disposed in a wellbore, comprising:

a firing head adapted to detonate;

an explosive apparatus connected to the firing head and adapted to detonate in response to the detonation of said firing head, said explosive apparatus including, current pulse generating means responsive to the detonation of said firing head for generating a current pulse;

electrical current carrying conductor means connected to the current pulse generating means for conducting said current pulse;

a plurality of explosive devices; and a plurality of exploding foil initiators connected, respectively, between the plurality of explosive devices and the current carrying conductor means and responsive to said current pulse conducting in said current carrying conductor means for substantially simultaneously detonating in response to said current pulse, said plurality of explosive devices substantially simultaneously detonating in response to the substantially simultaneous detonation of said plurality of exploding foil initiators.

48. The system of claim 47, wherein each of said plurality of exploding foil initiators comprise:

an exploding foil flying plate initiator.

49. The system of claim 47, wherein each of said plurality of exploding foil initiators comprise:

an exploding foil bubble activated initiator.

50. The system of claim 47, wherein each of said plurality of exploding foil initiators comprise:

an exploding bridgewire initiator.

51. The system of claim 47, wherein said explosive apparatus is a perforating apparatus and each of said explosive devices is a shaped charge.

52. The system of claim 47, wherein said firing head comprises an exploding foil initiator.

53. A perforating apparatus for detonating one or more explosive shaped charges, comprising:

current carrying conductor means electrically connected to a current pulse generating means and responsive to a pulse of current from said current pulse generating means for conducting said pulse of current;

one or more exploding foil initiator means electrically connected to said conductor means and responsive to said pulse of current conducting in said conductor means for detonating in response to said current; and a loading tube adapted for enclosing and holding said one or more explosive shaped charges, said current carrying conductor means including the one or more initiator means being wrapped around the one or more shaped charges enclosed by the loading tube, said one or more exploding foil initiator means on said conductor means being disposed adjacent, respectively, said one or more explosive shaped charges enclosed by said loading tube when said current carrying conductor means is wrapped around said one or more shaped charges, said one or more exploding foil initiator means on said current carrying conductor means detonating, said one or more explosive shaped charges in said loading tube detonating when said one or more exploding foil initiator means on said conductor means detonates.

54. The perforating apparatus of claim 53, wherein each of said one or more exploding foil initiator means on said conductor means comprises:

a first conductor means for receiving said pulse of current and conducting said current, electrically conductive bridge means electrically connected to said first conductor means and disposed adjacent one of said one or more explosive shaped charges for conducting said pulse of current and vaporizing in response to said current, and second conductor means electrically connected to said bridge means for receiving said said pulse of current from said bridge means and conducting said current, said bridge means of each of said one or more exploding foil initiator means on said conductor means vaporizing in response to said current, each of said one or more initiator means detonating when said bridge means vaporizes, said one or more explosive shaped charges held and enclosed by said loading tube detonating when said one or more exploding foil initiator means on said conductor means detonates.

55. The perforating apparatus of claim 54, wherein said current carrying conductor means comprises a flat cable conductor helically wrapped around said shaped charges, said one or more exploding foil initiator means being electrically connected to said flat cable conductor, said one or more exploding foil initiator means on said flat cable conductor means being disposed adjacent, respectively, said one or more explosive shaped charges of said loading tube when said flat cable conductor means is helically wrapped around said shaped charges.

56. The perforating apparatus of claim 54, wherein said current carrying conductor means comprises a flat sheet conductor having a length and a width wrapped around a circumference of said loading tube, said one or more exploding foil initiator means being electrically connected to said flat sheet conductor, said one or more exploding foil initiator means on said flat sheet conductor being disposed adjacent, respectively, said one or more explosive shaped charges of said loading tube when said flat sheet conductor is wrapped around said circumference of said loading tube.

57. The apparatus of claim 5, wherein said conductor means comprises a flat cable conductor, said flat cable conductor including said initiator means.

58. The apparatus of claim 5, wherein said conductor means comprises a flat sheet having a length and a width, said flat sheet including said initiator means.

59. The perforating gun of claim 8, wherein said initiator comprises an exploding foil initiator.

60. The perforating gun of claim 8, wherein said initiator comprises an exploding bridgewire initiator.

61. The perforating gun of claim 9, wherein said initiator comprises an exploding foil initiator.

62. The perforating gun of claim 9, wherein said initiator comprises an exploding bridgewire initiator.

* * * * *